US007174661B2

(12) United States Patent
Briscoe

(10) Patent No.: US 7,174,661 B2
(45) **Date of Patent: *Feb. 13, 2007**

(54) RELEASABLE COUPLING ASSEMBLY

(75) Inventor: Terry L. Briscoe, Portland, OR (US)

(73) Assignee: ESCO Corporation, Portland, OR (US)

( * ) Notice: Subject to any disclaimer, the term of this patent is extended or adjusted under 35 U.S.C. 154(b) by 77 days.

This patent is subject to a terminal disclaimer.

(21) Appl. No.: 10/824,490

(22) Filed: Apr. 15, 2004

(65) Prior Publication Data

US 2004/0221491 A1 Nov. 11, 2004

Related U.S. Application Data

(63) Continuation-in-part of application No. 10/425,934, filed on Apr. 30, 2003.

(51) Int. Cl.
*E02F 9/28* (2006.01)

(52) U.S. Cl. ..... 37/455; 37/456; 37/457; 403/370; 403/374.4

(58) Field of Classification Search ..... 37/455–457; 403/370, 374.1, 374.2, 374.3, 374.4, 379.2, 403/379.4; 172/753, 772, 772.5, 751
See application file for complete search history.

(56) References Cited

U.S. PATENT DOCUMENTS 1,021,185 A 3/1912 Foster
1,917,431 A 7/1933 O'Fallon
2,020,215 A 11/1935 Ross
2,547,789 A 4/1951 Skeel
2,576,225 A * 11/1951 Hostetter ..... 37/459
3,032,152 A 5/1962 Titsler
3,121,289 A 2/1964 Eyolfson
3,410,010 A * 11/1968 Ratowski ..... 37/454
3,413,740 A 12/1968 Peterson
3,494,245 A * 2/1970 Helton ..... 411/548
3,722,932 A 3/1973 Dougall
3,831,298 A * 8/1974 Helton et al. ..... 37/457
4,167,355 A 9/1979 Hansson
4,282,665 A 8/1981 Fletcher et al.
4,326,348 A 4/1982 Emrich (Continued)

OTHER PUBLICATIONS

Illustration of V61 Hot Slag Pin Sold by ESCO Before Jul. 2, 2002.

*Primary Examiner*—Thomas A Beach
(74) *Attorney, Agent, or Firm*—Steven P. Schad

(57) ABSTRACT

A lock that includes a wedge that is used to releasably secure separable components of an assembly together. The wedge can be used with a spool. The wedge and spool are threadedly coupled together to drive the wedge into and out of an opening in the assembly without hammering or prying. The direct coupling of the wedge and spool eliminates the need for bolts, washers, nuts and other hardware so as to minimize the number of parts. As a result, the lock is inexpensive to make, easy to use, and unlikely to become inoperative because of lost or broken parts or due to fines or other difficulties encountered in harsh digging environments. Further, the wedge can be driven into the assembly to provide the degree of tightness necessary for the intended operation and/or to re-tighten the assembly after incurring wear during use. A latch assembly is preferably provided to securely hold the wedge in place and avoid an undesired loss of parts during use.

44 Claims, 14 Drawing Sheets

U.S. PATENT DOCUMENTS 4,372,703 A 2/1983 Szostak
4,380,102 A 4/1983 Hansson
4,433,496 A 2/1984 Jones et al.
4,540,309 A 9/1985 Hansson
5,052,134 A 10/1991 Bierwith
5,068,986 A 12/1991 Jones
5,074,062 A 12/1991 Hahn et al.
5,233,770 A 8/1993 Robinson
5,272,824 A * 12/1993 Cornelius ..... 37/458
5,311,681 A 5/1994 Ruvang et al.
5,331,754 A 7/1994 Ruvang
5,361,520 A 11/1994 Robinson
5,410,826 A 5/1995 Immel et al.
5,452,529 A 9/1995 Neuenfeldt et al.
5,465,512 A 11/1995 Livesay et al.
5,469,648 A 11/1995 Jones et al.
5,491,915 A 2/1996 Robinson
5,564,206 A 10/1996 Ruvang
5,617,655 A * 4/1997 Launder et al. ..... 37/457
5,638,621 A 6/1997 Keech et al.
5,653,048 A * 8/1997 Jones et al. ..... 37/452
5,784,813 A 7/1998 Balassa et al.
5,833,323 A 11/1998 Massa et al.
5,852,888 A * 12/1998 Cornelius ..... 37/457
5,868,518 A 2/1999 Chesterfield et al.
5,964,547 A 10/1999 Brinkley
6,009,644 A 1/2000 Hedley
6,032,390 A * 3/2000 Bierwith ..... 37/456
6,301,810 B1 10/2001 Fidler

* cited by examiner

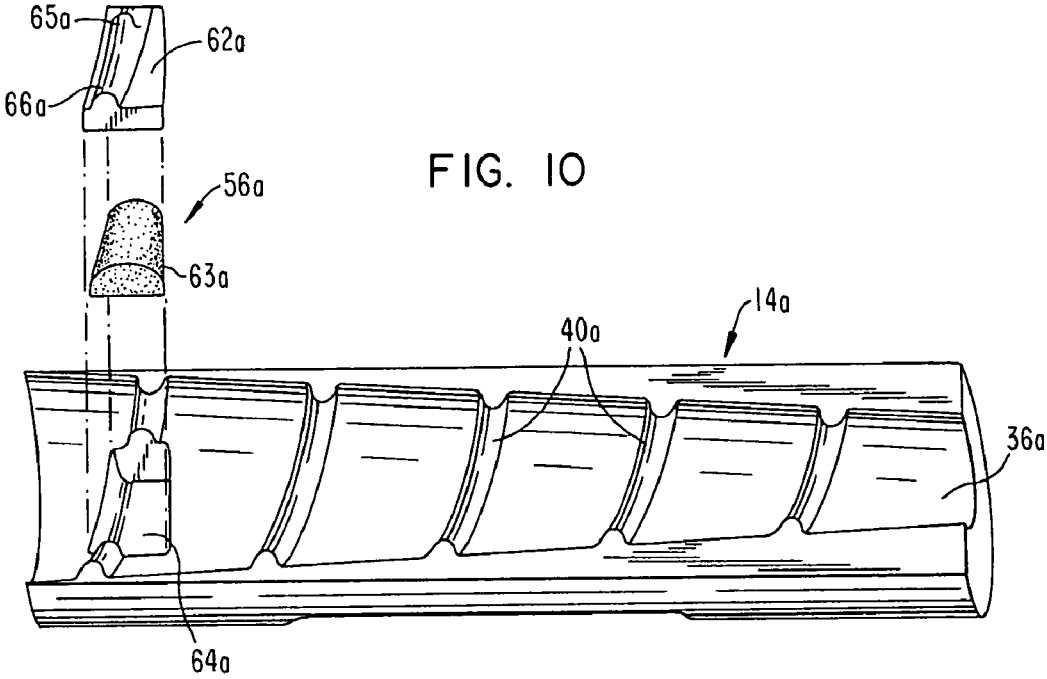
FIG. 10
FIG. 11
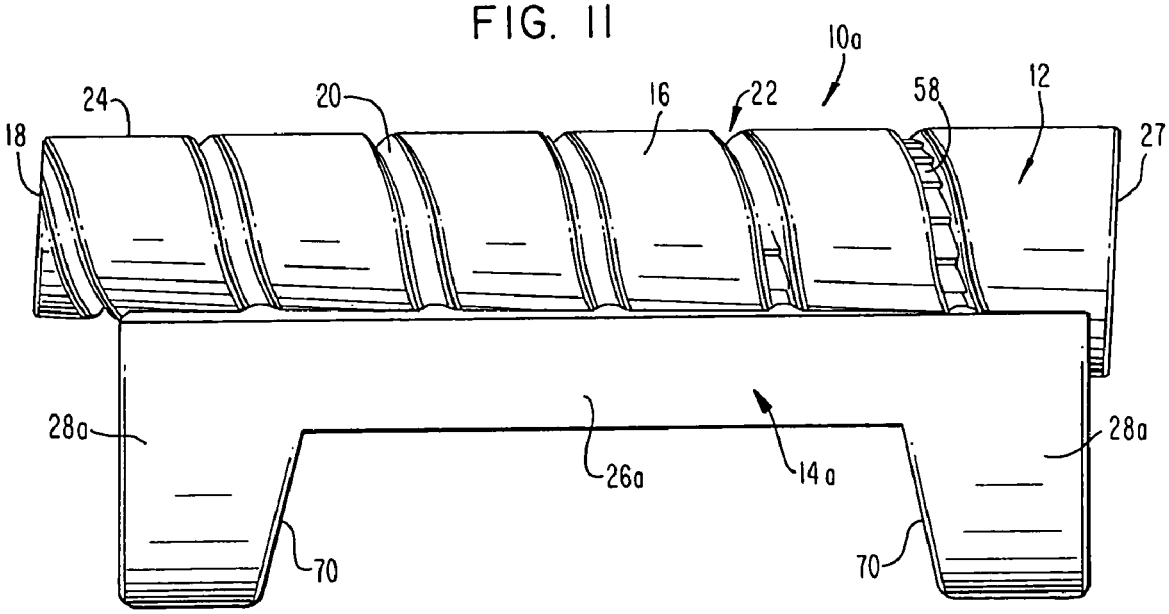

FIG. 17
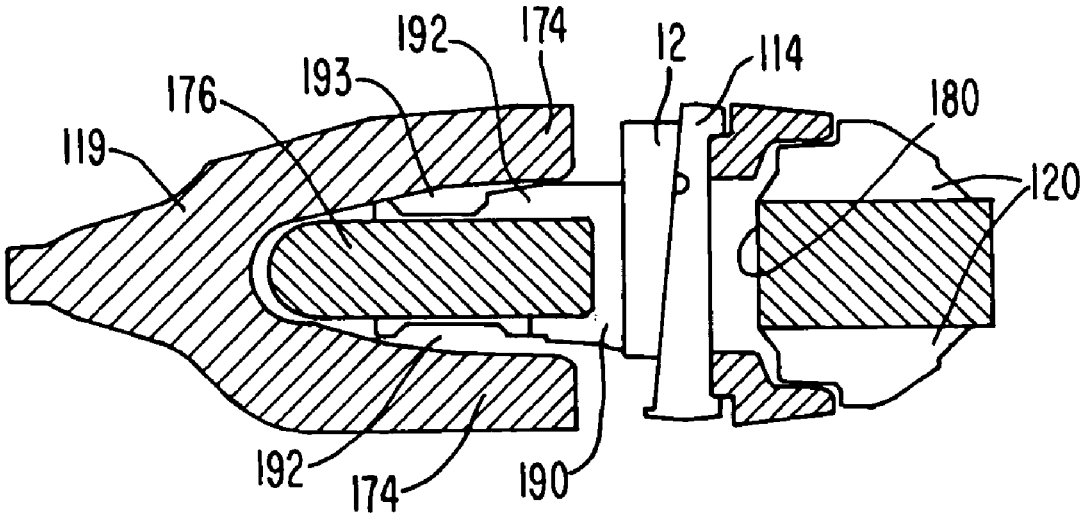
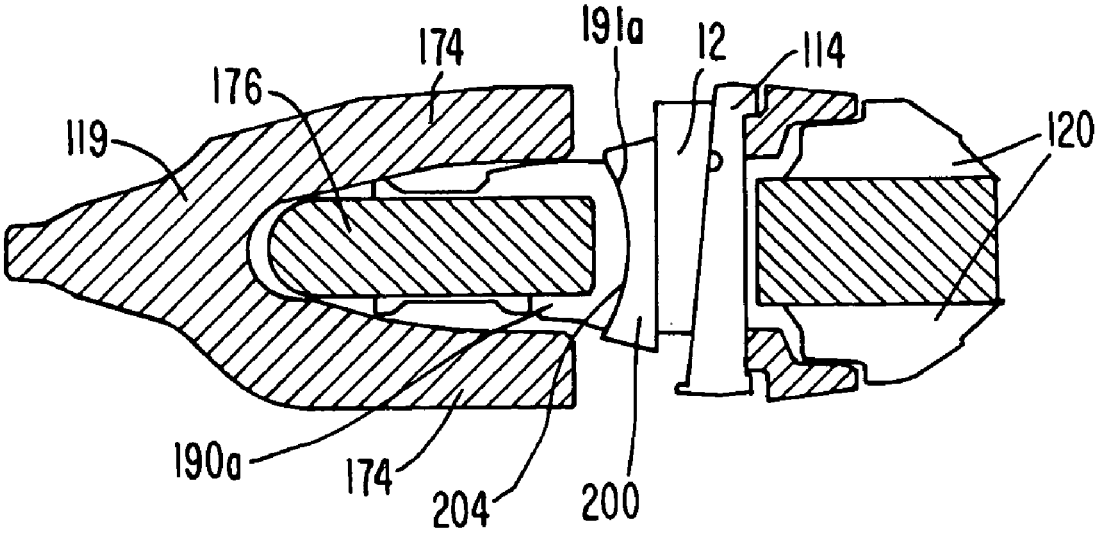
FIG. 18

RELEASABLE COUPLING ASSEMBLY

This application is a continuation in part of U.S. Ser. No. 10/425,934 filed Apr. 30, 2003.

FIELD OF THE INVENTION

The present invention pertains to a coupling assembly for releasably securing separable parts together, and especially for securing together components of a wear assembly used in excavating or the like.

BACKGROUND OF THE INVENTION

Excavating equipment typically includes various wear parts to protect underlying products from premature wear. The wear part may simply function as a protector (e.g., a wear cap) or may have additional functions (e.g., an excavating tooth). In either case, it is desirable for the wear part to be securely held to the excavating equipment to prevent loss during use, and yet be capable of being removed and installed to facilitate replacement when worn. In order to minimize equipment downtime, it is desirable for the worn wear part to be capable of being easily and quickly replaced in the field. Wear parts are usually formed of three (or more) components in an effort to minimize the amount of material that must be replaced on account of wearing. As a result, the wear part generally includes a support structure that is fixed to the excavating equipment, a wear member that mounts to the support structure, and a lock to hold the wear member to the support structure.

As one example, an excavating tooth usually includes an adapter as the support structure, a tooth point or tip as the wear member, and a lock or retainer to hold the point to the adapter. The adapter is fixed to the front digging edge of an excavating bucket and includes a nose that projects forward to define a mount for the point. The adapter may be a single unitary member or may be composed of a plurality of components assembled together. The point includes a front digging end and a rearwardly opening socket that receives the adapter nose. The lock is inserted into the assembly to releasably hold the point to the adapter.

The lock for an excavating tooth is typically an elongate pin member which is fit into an opening defined cooperatively by both the adapter and the point. The opening may be defined along the side of the adapter nose, as in U.S. Pat. No. 5,469,648, or through the nose, as in U.S. Pat. No. 5,068,986. In either case, the lock is inserted and removed by the use of a large hammer. Such hammering of the lock is an arduous task and imposes a risk of harm to the operator.

The lock is usually tightly received in the passage in an effort to prevent ejection of the lock and the concomitant loss of the point during use. The tight fit may be effected by partially unaligned holes in the point and adapter that define the opening for the lock, the inclusion of a rubber insert in the opening, and/or close dimensioning between the lock and the opening. However, as can be appreciated, an increase in the tightness in which the lock is received in the opening further exacerbates the difficulty and risk attendant with hammering the locks into and out of the assemblies.

The lock additionally often lacks the ability to provide substantial tightening of the point onto the adapter. While a rubber insert will provide some tightening effect on the tooth at rest, the insert lacks the strength needed to provide any real tightening when under load during use. Most locks also fail to provide any ability to be re-tightened as the parts become worn. Moreover, many locks used in teeth are susceptible to being lost as the parts wear and the tightness decreases.

These difficulties are not limited strictly to the use of locks in excavating teeth, but also apply to the use of other wear parts used in excavating operations. In another example, the adapter is a wear member that is fit onto a lip of an excavating bucket, which defines the support structure. While the point experiences the most wear in a tooth, the adapter will also wear and in time need to be replaced. To accommodate replacement in the field, the adapters can be mechanically attached to the bucket. One common approach is to use a Whisler style adapter, such as disclosed in U.S. Pat. No. 3,121,289. In this case, the adapter is formed with bifurcated legs that straddle the bucket lip. The adapter legs and the bucket lip are formed with openings that are aligned for receiving the lock. The lock in this environment comprises a generally C-shaped spool and a wedge. The arms of the spool overlie the rear end of the adapter legs. The outer surfaces of the legs and the inner surfaces of the arms are each inclined rearward and away from the lip. The wedge is then ordinarily hammered into the opening to force the spool rearward. This rearward movement of the spool causes the arms to tightly pinch the adapter legs against the lip to prevent movement or release of the adapter during use. As with the mounting of the points, hammering of the wedges into the openings is a difficult and potentially hazardous activity.

In many assemblies, other factors can further increase the difficulty of removing and inserting the lock when replacement of the wear member is needed. For example, the closeness of adjacent components, such as in laterally inserted locks (see, e.g., U.S. Pat. No. 4,326,348), can create difficulties in hammering the lock into and out of the assembly. Fines can also become impacted in the openings receiving the locks making access to and removal of the locks difficult. Additionally, in Whisler style attachments, the bucket must generally be turned up on its front end to provide access for driving the wedges out of the assembly. This orientation of the bucket can make lock removal difficult and hazardous as the worker must access the opening from beneath the bucket and drive the wedge upward with a large hammer. The risk is particularly evident in connection with dragline buckets, which can be very large. Also, because wedges can eject during service, it is common practice in many installations to tack-weld the wedge to its accompanying spool, thus, making wedge removal even more difficult.

There has been some effort to produce non-hammered locks for use in excavating equipment. For instance, U.S. Pat. Nos. 5,784,813 and 5,868,518 disclose screw driven wedge-type locks for securing a point to an adapter and U.S. Pat. No. 4,433,496 discloses a screw-driven wedge for securing an adapter to a bucket. While these devices eliminate the need for hammering, they each require a number of parts, thus, increasing the complexity and cost of the locks. The ingress of fines can also make removal difficult as the fines increase friction and interfere with the threaded connections. Moreover, with the use of a standard bolt, the fines can build up and become "cemented" around the threads to make turning of the bolt and release of the parts extremely difficult.

SUMMARY OF THE INVENTION

The present invention pertains to an improved coupling assembly for releasably holding separable parts together in a secure, easy, and reliable manner. Further, the lock of the present invention can be installed and removed simply by using a manual or powered wrench. The need to hammer or pry the lock into and out of the assembly is eliminated.

The present invention is particularly useful for securing a wear member to a support structure in conjunction with an excavating operation. The lock of the present invention is easy to use, is securely held in the wear assembly, alleviates the risk associated with hammering a lock into and out of a wear assembly, and operates to effectively tighten the wear member onto the support structure.

In one aspect of the invention, a tapered lock member is formed with a threaded formation that is used to pull the lock member into a locking position in the assembly. The lock member, then, bears against the assembly to hold the components of the assembly together. The use of a threaded formation on the lock member also reduces the risk that the lock member will be ejected during use as compared to a lock that is simply hammered into place.

In another aspect of the present invention, a wedge and a spool are threadedly coupled together to drive the wedge into and out of the wear assembly without hammering. The direct coupling of the wedge and spool eliminates the need for bolts, washers, nuts and other hardware so as to minimize the number of parts. As a result of this efficient construction, the lock is inexpensive to make, easy to use, and unlikely to become inoperative because of lost or broken parts or due to fines or other difficulties encountered in harsh digging environments. Further, the wedge can be selectively driven into the assembly to provide the degree of tightness necessary for the intended operation and/or to re-tighten the assembly after incurring wear during use.

In one preferred construction, the wedge includes a thread formation with a wide pitch to form a sizable land segment by which the wedge can directly apply pressure to the wear assembly for holding the wear member to the support structure. In one embodiment, the wedge is formed with a helical groove along its outer periphery to engage helical ridge segments formed in a generally trough shaped recess along the spool or other part of the assembly. Rotation of the wedge moves the wedge along the spool, and into and out of the wear assembly. Movement of the wedge into the assembly increases the depth of the lock, and thereby tightens the engagement of the wear member onto the support structure.

A latch assembly is preferably provided to securely hold the wedge in place and avoid an undesired loss of parts during use. In one preferred construction, the wedge is formed with teeth that interact with a latch provided in an adjacent component such as the spool, wear member or support structure. The teeth and latch are formed to permit rotation of the wedge in a direction that drives the wedge farther into the opening, and to prevent rotation in a direction that retracts the wedge. The latch may also function to retain the lock in the assembly when the wear member and/or support structures begin to wear.

The inventive lock is simple, sound, reliable, and requires only minimal components. The lock is also intuitively easy for the operator to understand. Elimination of hammering also makes replacement of a wear member easy and less hazardous. Moreover, the lock is able to provide selective tightening of the wear assembly to facilitate re-tightening of the wear members or a better original mounting when, for example, the support structure is partially worn. These and other advantageous will be evident in the drawings and description to follow.

BRIEF DESCRIPTION OF THE DRAWINGS

FIG. 10 is an exploded, perspective view of the alternative spool.

FIG. 11 is a side view of a second lock in accordance with the present invention including the alternative spool. This lock is adapted to secure an adapter to a bucket lip in a Whisler style connection.

FIG. 17 is a cross-sectional view along the same line as FIG. 12 for an alternative embodiment.

FIG. 18 is a cross-sectional view along the same line as FIG. 12 for another alternative embodiment.

DETAILED DESCRIPTION OF THE PREFERRED EMBODIMENTS

The present invention pertains to a coupling assembly for releasably holding separable parts together. While the invention has a broader application, it is particularly useful in releasably securing a wear member to a support structure in an excavating operation. The wear member may, for example, be a point, an adapter, a shroud or other replaceable component.

Figure 1:
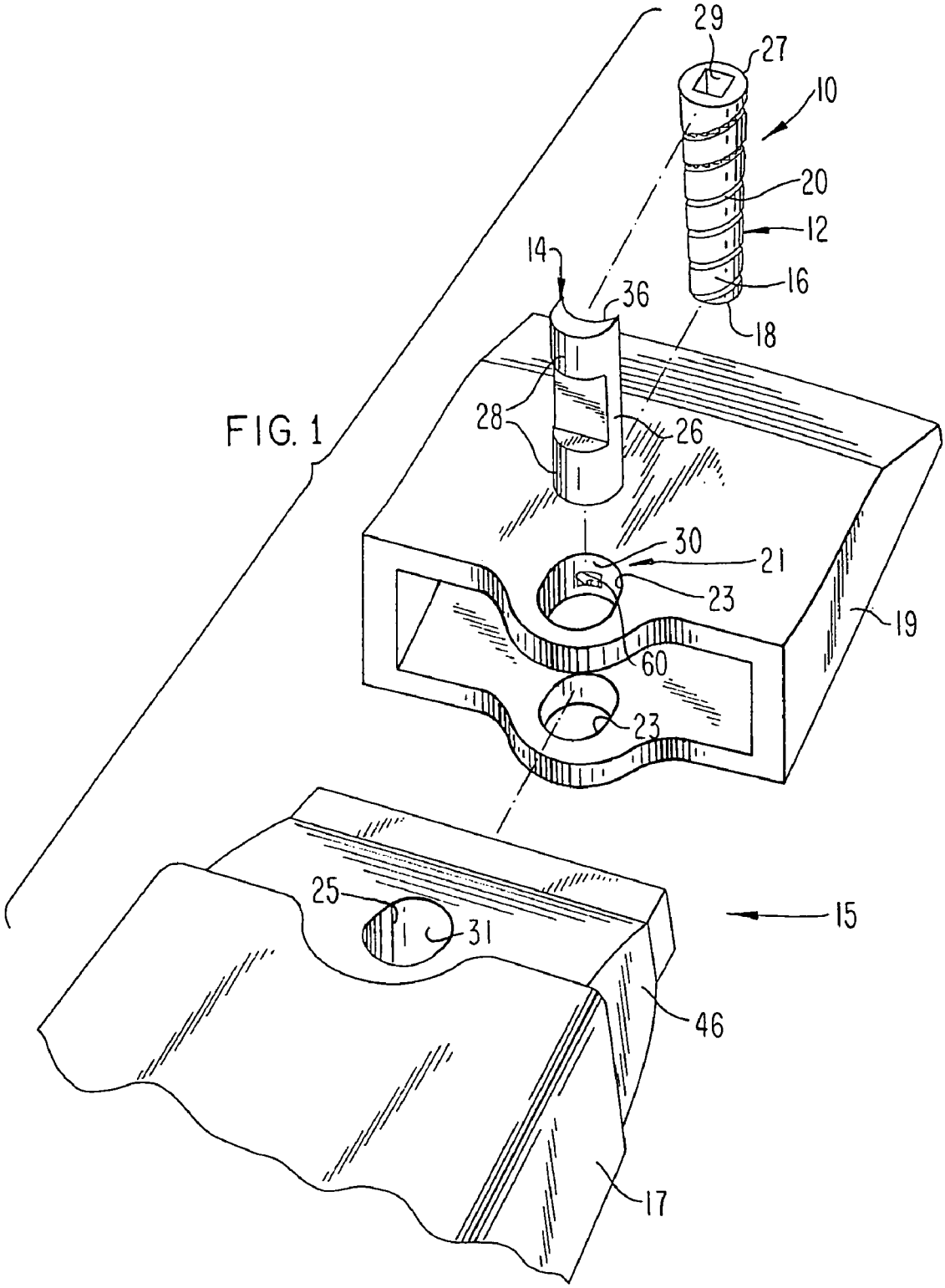
FIG. 1 is a perspective view of a coupling assembly in accordance with the present invention securing a point to an adapter.
Figure 8:
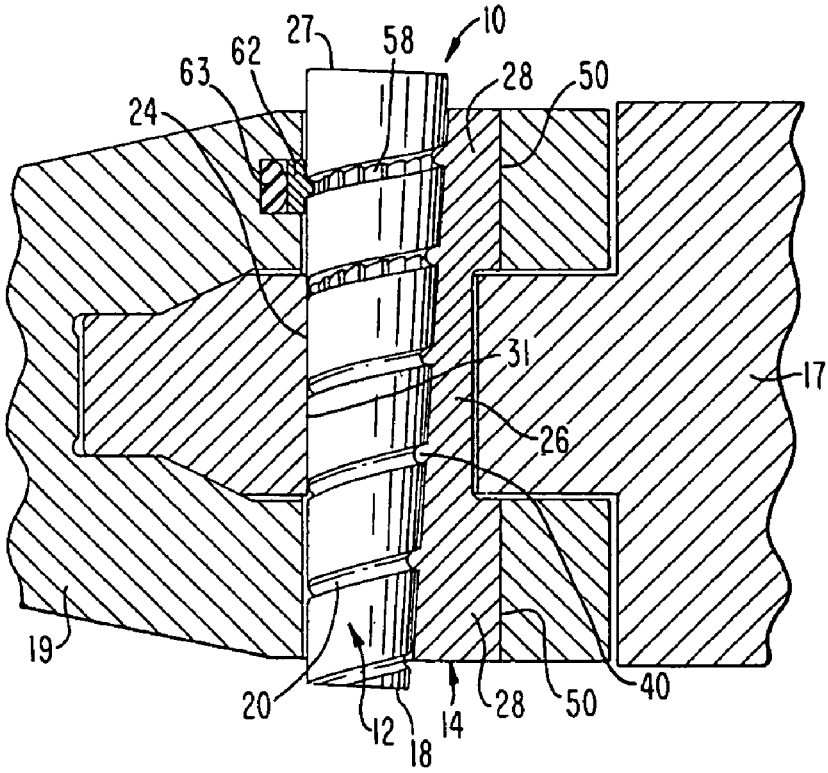
FIG. 8 is a cross-sectional view of the coupling assembly taken along line 8—8 in FIG. 1 in the assembled condition.

In one preferred construction, the lock 10 includes a wedge 12 and a spool 14 (FIGS. 2–5). Although the lock can be used to secure a wide range of components together, it is shown in FIG. 1 holding together the parts of an excavator tooth. In this embodiment of the invention, the lock is placed in a wear assembly 15 wherein the support structure is formed as an adapter 17 and the wear member is defined as a point or tip 19. Lock 10 is received into an opening 21 in wear assembly 15 that is cooperatively defined by holes 23 in point 19 and hole 25 in adapter 17 so as to releasably hold the point to the adapter (FIGS. 1 and 8). Holes 23 and 25 are each preferably elongated longitudinally to prevent misalignment of the wedge and spool, although the holes could be circular or have other shapes.

The wedge 12 preferably has a frusto-conical shape with a rounded exterior surface 16 that tapers toward a front end 18 (FIGS. 1–4). A thread formation 22, preferably in the form of a helical groove 20 with a wide pitch, is formed along the exterior surface 16 of the wedge. Accordingly, a rather wide, helically shaped land segment 24 exists between the adjacent spiraling groove segments. This land segment presents a large surface area to press against the front surface 31 of the hole 25 in adapter 17 and the wall 37 of recess 36 in spool 14. The relatively large land segment enables the lock to resist large loads with acceptable levels of stress and without the need for threads to be formed in the wall of hole 25 in the adapter. The wide pitch of the groove 20 also permits the wedge to be quickly moved into and out of the opening 21.

In one preferred construction, the pitch of the thread on the wedge is on the order of one inch and the groove forming the thread about ⅛ of an inch wide, although the pitch and groove width could vary widely. The groove is preferably formed with curved corners to form a robust thread that is not susceptible to peening or other damage. The rear end 27 of the wedge is provided with a turning formation 29 to facilitate engagement with a tool, such as a wrench, for turning the wedge. In the preferred embodiment, formation 29 is a square socket, although other arrangements could be used.

The taper of the wedge can be varied to provide an increased or decreased take-up of the wear member on the support structure. For example, if the taper of the wedge is increased, the rate at which the wear member moves to the set position on the support structure is increased, but at the expense of tightening force (i.e., more torque is required to turn the wedge). The taper of the wedge can be designed to match the particular task. In all cases the holding power of the lock would be about the same so long as the wedge is not formed too small at the forward end to provide sufficient strength.

Figure 2:
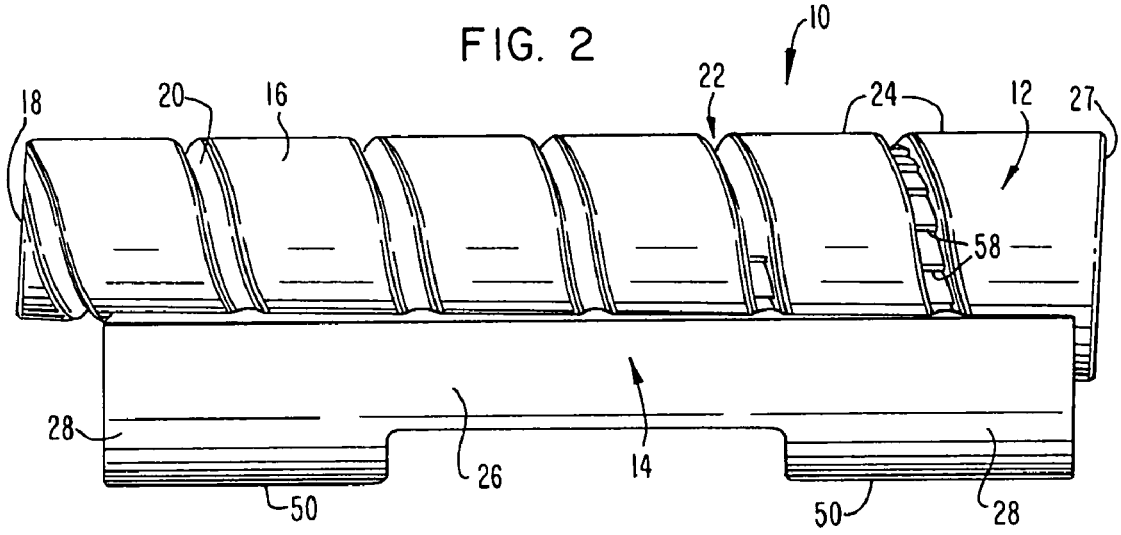
FIG. 2 is a side view of a lock in accordance with the present invention.
Figure 3:
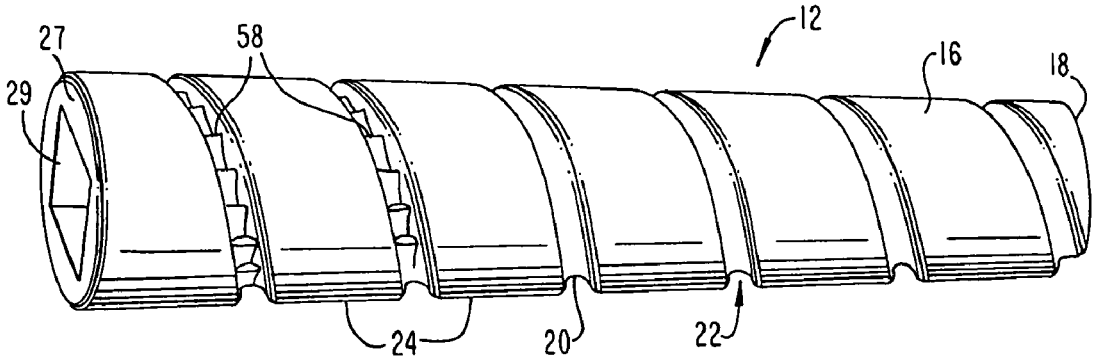
FIG. 3 is a perspective view of a wedge of the lock.
Figure 4:
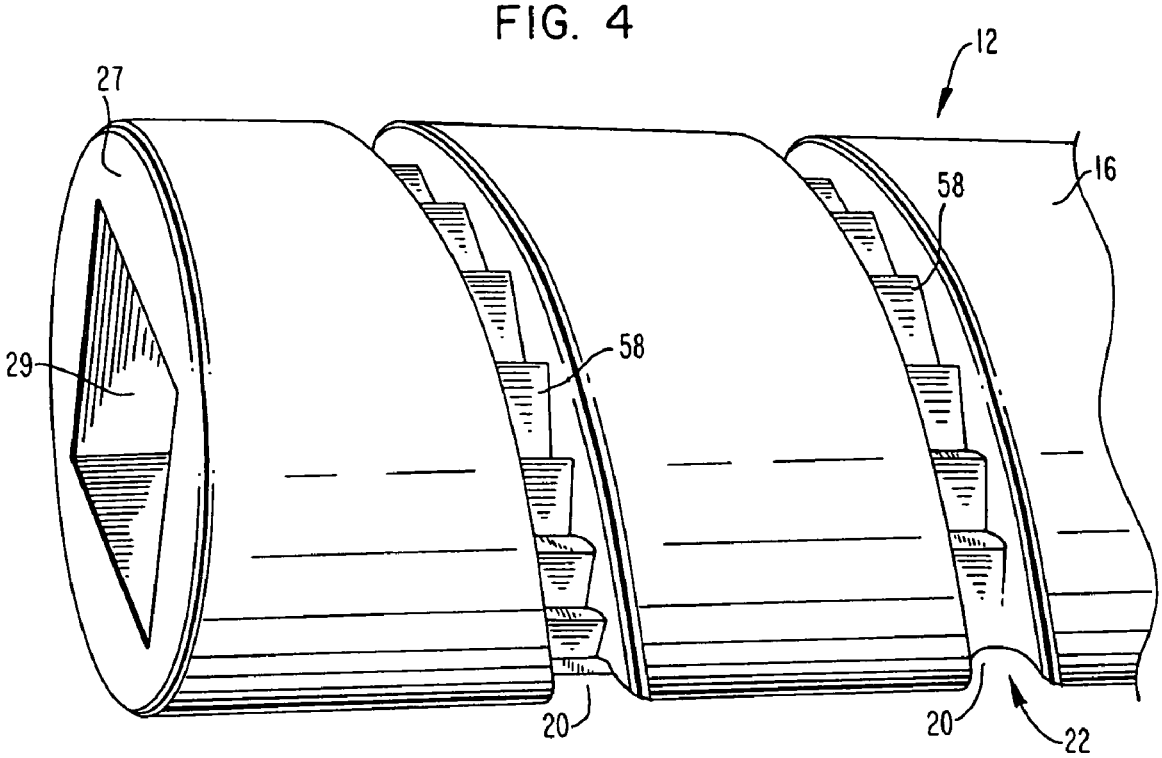
FIG. 4 is an enlarged, partial, perspective view of the wedge.
Figure 5:
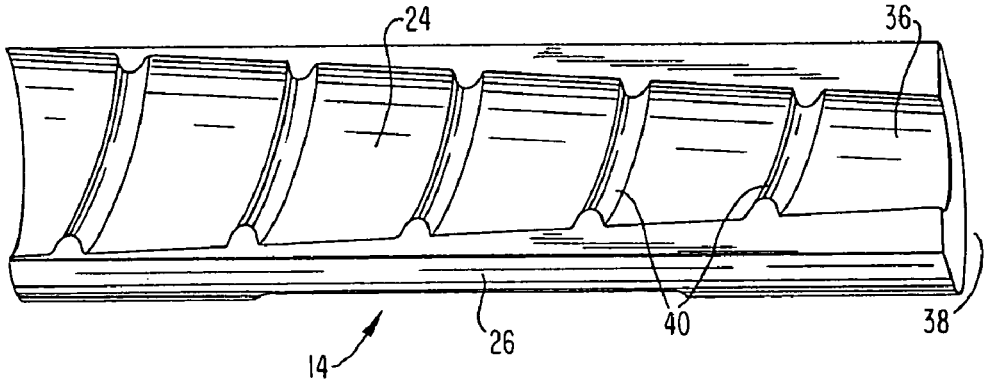
FIG. 5 is a perspective view of a spool of the lock.

The spool 14 preferably has a generally C-shaped configuration with a body 26 and arms 28 (FIGS. 1, 2 and 5). In this example, the arms are fairly short so as to press against the rear wall portions 30 of holes 23 in point 19 (FIG. 8). However, the particular shape and size of the arms can vary widely depending on the construction and use of the parts receiving the lock. Additionally, the arms could be omitted entirely if the opening in the support structure were sized to permit the rear wall of the body to press against the rear wall portions in the openings of the wear member and the spool was adequately anchored. Similarly, in this type of construction, the lock could be reversed such that the wedge pressed against the wear member and the spool against the support structure.

The body 26 of spool 14 is formed with a generally trough shaped recess 36 to receive a portion of the wedge (FIG. 5). The recess is provided with a thread formation 42 that is defined as at least one projection to fit within groove 20. In this way, the wedge and spool are threadedly coupled together. Although the projection can take the form of a wide range of shapes and sizes, recess 36 preferably includes multiple ridges 40 on the spool to complement groove 20 on wedge 12. The ridges 40 are shaped as helical segments having the same pitch as the helical groove 20 so that the ridges are received into the groove to move the wedge in or out of the opening when the wedge is rotated. While ridges 40 are preferably provided along the entire length of recess 36, fewer ridges or even one ridge could be provided if desired. Further, each ridge preferably extends across the entire recess 36, but can have a lesser extension if desired.

In the preferred construction, the helical groove 20 has the same pitch along the length of the wedge. Since the wedge is tapered, the angle of the thread changes to become more shallow as the groove extends from the forward end 18 to the rear end 27. This variation requires the allowance of clearance space between the internal and external thread so they can cooperate and avoid binding with each other. This construction, then, forms relative loose fitting threads.

Figure 6:
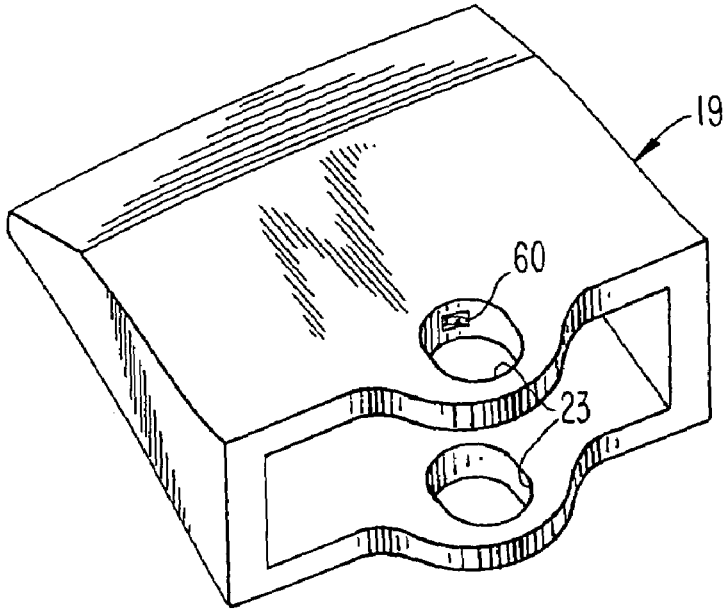
FIG. 6 is a perspective view of a wear member having a latch of the inventive coupling assembly.
Figure 7:
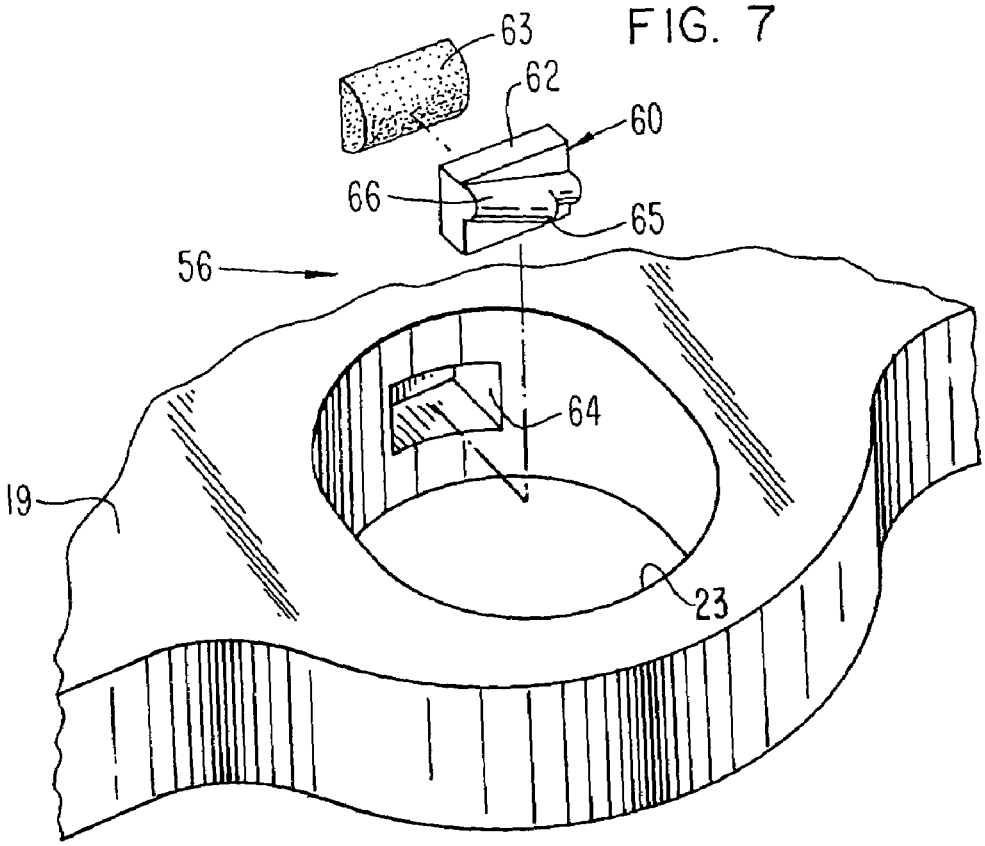
FIG. 7 is a partial, exploded, perspective view of the wear member shown in FIG. 6.
Figure 9:
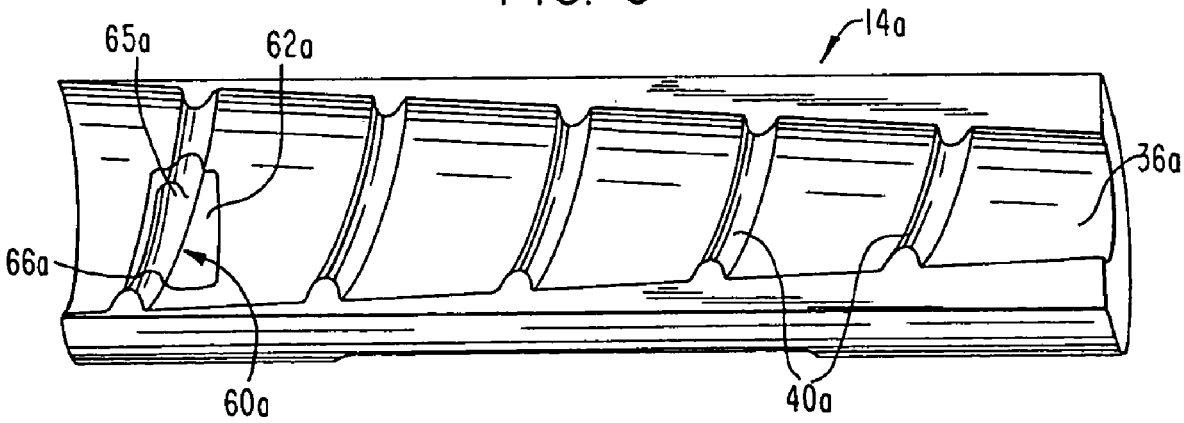
FIG. 9 is a perspective view of an alternative spool for the lock.

As an alternative construction, a ridge(s) to engage groove 20 on the wedge could be formed on the front wall portion of the hole 23 defined in point 19 in addition to or in lieu of the ridges 40 on the spool. The ridge could simply be provided by the body 62, as seen in FIGS. 6 and 7, but could also include an extension and/or other ridges on the front wall portion of the hole, similar to the inclusion of body 62*a* in spool 14*a* (as seen in FIGS. 9 and 10). Similarly, one or more ridges (or other projections) to engage groove 20 could instead be formed on the wall structure of the hole 25 in adapter 17 (in addition to or in lieu of the other ridges). In these alternatives where a thread formation is formed on the point and/or adapter, the wedge could be inserted into the opening without a spool to hold the wear member to the support structure. As can be appreciated, the hole in the point would need to be smaller to permit direct bearing contact between the wedge and the rear wall portions of the holes in the point or the ridge provided on the rear wall of the opening.

Figure 15:
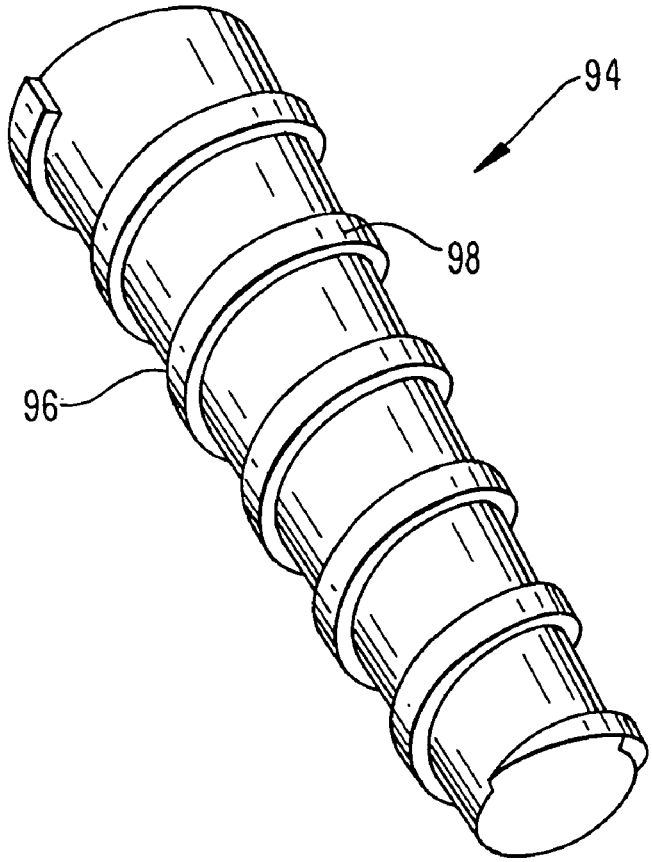
FIG. 15 is a perspective view of an alternative wedge construction.
Figure 16:
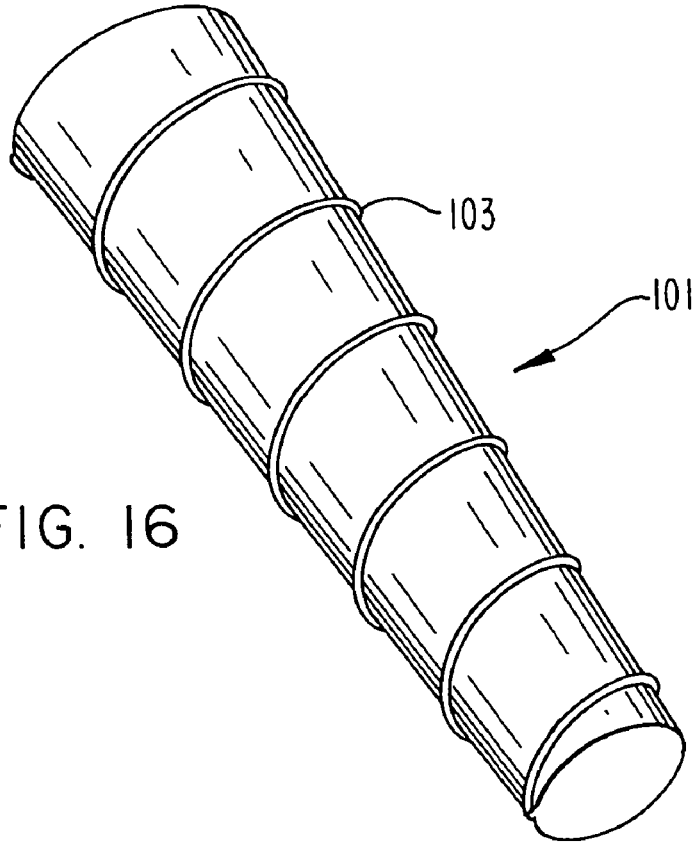
FIG. 16 is a perspective view of another alternative wedge construction.

The thread formations may also be reversed so that grooves are formed in the point, adapter and/or spool to receive a helical ridge formed on the wedge. While a ridge may be used to form the thread on the wedge with grooves only in the spool and not in the adapter wall (or vice versa), the ridges do not form as good a bearing surface as land segment 24 without the matching grooves in the opposing surfaces. Nevertheless, a helical ridge on the wedge may be used even with a smooth adapter wall and/or smooth recess in the spool in lower stress environments. In this alternative, the wedge 94 would preferably have a ridge 96 with a blunt outer edge 98 (FIG. 15). Nevertheless, the provision of a ridge on the wedge could be designed to bite into the adapter wall and/or spool. Finally, the wedge 101 could be formed with a tapping ridge 103 that cuts a thread in the spool and/or adapter wall as it is threaded into the assembly (FIG. 16).

Recess 36 in spool 14 preferably tapers toward one end 38 to complement the shape of the wedge and position forward portions of the land segment 24 bearing against the adapter to be generally vertical for a solid, secure contact with the nose of adapter 17 (FIGS. 5 and 8). This orientation stabilizes the wedge and lessens the stresses engendered in the components when the wedge is inserted tightly into the wear assembly 15. In a preferred construction, the recess is tapered at twice the taper of the wedge so as to place forward portions of the land segment 24 in a vertical orientation (as illustrated). As can be appreciated, the purpose of this construction is to orient the forward portions of the land segment substantially parallel to the wall of the member which they engage as opposed being in a strictly vertical orientation. In the preferred construction, recess 36 is provided with a concave curve that is designed to complement the shape of the wedge when the wedge is at the end of its projected travel in a tightening direction. In this way, the wedge is best able to resist the applied loads and not bind with the spool during tightening. Nevertheless, other shapes are possible.

In use, lock 10 is inserted into opening 21 in the wear assembly 15 when the wear member 19 is mounted on the nose 46 of adapter 17 (FIGS. 1 and 8). The lock 10 is preferably placed into opening 21 as separate components (i.e., with the spool being inserted first) but may in some cases be inserted collectively as a unit (i.e., with the wedge placed partially into the recess 36). In either case, the free ends 50 of arms 28 are placed in engagement with the rear wall portions 30 of holes 23 in wear member 19. The wedge is then rotated to drive it into opening 21 so that the forward portions of land segment 24 of wedge 12 press against the front wall portion 31 of hole 25, and arms 28 of spool 14 press on the rear wall portions 30 of holes 23. Continued rotation of the wedge further enlarges the depth of the lock (i.e., the distance in a direction parallel to the axis of the movement of the point onto the adapter nose) so that the arms 28 push the wear member 19 farther onto the support structure 17. This rotation is stopped once the desired tightness has been achieved. By using a tapered wedge in the lock receiving opening 21, a significant clearance exists between much of the wedge and the walls of the opening. As a result, fines from the digging operation would generally not become firmly impacted into the opening. Even if fines did become impacted in the opening, the wedge would still be easily retracted by turning the wedge with a wrench. The tapered shape of the wedge makes the opening around the lock larger at the bottom of the assembly in the illustrated orientation. With this arrangement, the fines tend to fall out as the wedge is loosened. The relatively wide groove in the wedge in the preferred construction also tends to enable release of fines from the lock and thereby avoid having the lock becoming "cemented" into the assembly. Moreover, because of the tapered shape of the threaded wedge, the assembly is quickly loosened with just a short turn of the wedge. Rubber caps or the like (not shown) could be used to inhibit the ingress of fines in socket 29 if desired.

In a preferred construction, a latching assembly 56 is provided to retain the wedge in the opening. As seen in FIGS. 2–4 and 8, ratchet teeth 58 are preferably provided within groove 20 to cooperate with a latch 60. By being recessed within the groove, the teeth do not disrupt the threaded coupling of the wedge and the spool, or the engagement of the wedge with support structure 17 and spool 14. The ratchet teeth are adapted to engage latch 60, which is mounted in either the wear member 19 (FIGS. 6–8), spool 14 (FIGS. 10 and 12) or support structure 17 (not shown). The teeth are inclined to permit rotation of the wedge in a tightening direction but prevent rotation in a loosening direction. The teeth generally need to be only formed along about one third the length of groove 20 to ensure engagement of the latch with the teeth when the wedge is fully tightened for use. Of course, the teeth could be positioned along more or less than about one-third the length of the groove as desired. The number of teeth and their location on the wedge depend largely on the amount of travel expected between the parts being coupled together, and the expected wear of the components and retightening of the lock. The teeth will preferably be positioned along the rear end of the wedge, i.e., where the wedge is widest, so that the latch 60 is securely engaged against the teeth and stress in the wedge is minimized. Nevertheless, other arrangements are possible. The teeth may have a reversible style that inhibits unwanted turning in both directions, but which will permit turning under the force of a wrench or the like—i.e., the detent can retract under sufficient load to permit rotation of the wedge in the tightening or untightening directions. Further, omission of the teeth is possible. Another alternative is to design latch 60 to apply a force on the wedge to frictionally inhibit inadvertent turning of the wedge during use.

Latch 60 preferably comprises a body 62 and a resilient member 63 that are fit within a cavity 64 that is open in one of the holes 23 (FIGS. 6 and 7). The body is provided with a detent 65 to engage ratchet teeth 58 on the wedge 12. The resilient member presses the detent 65 into engagement with the ratchet teeth and permits the body to retract into the cavity as the wider portions of the wedge are driven into opening 21. In the preferred construction, body 62 includes a helical ridge 66 that complements ridges 40 on spool 14, i.e., the ridge has the same pitch and is positioned to match the trajectory of ridges 40. Since the spool is placed into opening 21 by the operator, cavity 64 may receive body 62 with clearance to enable the body to shift as needed to ensure that ridge 66 complements ridges 40. The clearance need not be great (e.g., on the order of 0.03 of an inch in larger systems) because the spool has only a small range of adjustment where it can be properly positioned with the arms against the walls defining holes 23. Additionally, groove 20 could be formed with a narrowing width as it extends from front end 18 of wedge 12 toward rear end 27. In this way, the groove could become easily engaged with ridges 40 on spool 14 and ridge 66 on body 62, even if initially misaligned, and gradually shift body 62 into alignment with ridge 40 as the groove narrows. The body 62 is preferably bonded to resilient member 63 by an adhesive (or via casting), which in turn, is bonded in cavity 64 by an adhesive. Nevertheless, the body and resilient member could be held in cavity 64 by friction or other means. The body is preferably composed of plastic, steel or any other material that provides the requisite force to hold the wedge from turning during operation of the excavator and the resilient member of rubber, although other materials could be used.

In use, ridge 66 is received into groove 20. As the wedge reaches a tightened position, detent 65 engages teeth 58. However, due to the inclination of the teeth and the provision of resilient member 63, the latch rides over the teeth as the wedge is rotated in the tightening direction. The detent 65 locks with teeth 58 to prevent any reverse rotation of the wedge. The detent is designed to be broken from body 62 when the wedge is turned in the release direction with a wrench. The force to break the detent is within normal forces expected to be applied by a wrench but still substantially more torque than would be expected to be applied to the wedge through normal use of the excavating tooth. Alternatively, a slot or other means could be provided to permit retraction of the latch and disengagement of the detent from the teeth for reverse rotation of the wedge. Receipt of the ridge 66 and ridges 40 in groove 20 function to retain the wedge in opening 21 even after looseness develops in the tooth on account of wearing of the surfaces.

Alternatively, the latch 60 could be positioned within a cavity formed along the front wall portion 51 of hole 25 in adapter 17. The latch would function in the same way as described above when mounted in point 19. In addition, an insert (not shown) could be positioned between wedge 12 and front wall portion 51 of hole 25 if desired. The insert may include a recess with ridges like recess 36 in spool 14 or simply have a smooth recess to receive the wedge. The insert could be used to fill the space of a large opening in the adapter (or other support structure) or to accommodate a wedge formed with threads having a smaller pitch for greater mechanical advantage or other reasons, and still provide a large surface area with which to bear against the adapter. Further, the front surface of the insert may be formed to mate with the front wall portion 51 of hole 25 to increase the bearing area between the adapter and the lock, and thereby reduce the induced stresses in the parts. A latch or the like may also be used to retain the insert in place. A latch, like latch 60, could also be provided in the insert.

In an alternative embodiment (FIGS. 9 and 10), lock 10*a* has the latch 60*a* mounted in a cavity 64*a* formed in recess 36*a* of spool 14*a*. In the same way as latch 60, latch 60*a* preferably includes a body with a helical ridge 66*a* and detent 65*a*, and a resilient member 63*a*. Latch 60*a* would operate in the same way as discussed above for latch 60. The teeth 58 on the wedge would be formed in the same way, irrespective of whether the latch is mounted in the spool, the wear member or the support structure. As seen in FIG. 9, ridge 66*a* would be positioned as a continuation of one of the ridges 40. Although latch 60 is shown aligned with the ridge 40 closest to rear end 27 of the wedge, the latch could be formed anywhere along recess 36*a*. If the latch were repositioned, the teeth 58 on wedge 12 may also need to be re-positioned in the groove 20 to engage the detent 65*a* of latch 60*a*.

Figure 12:
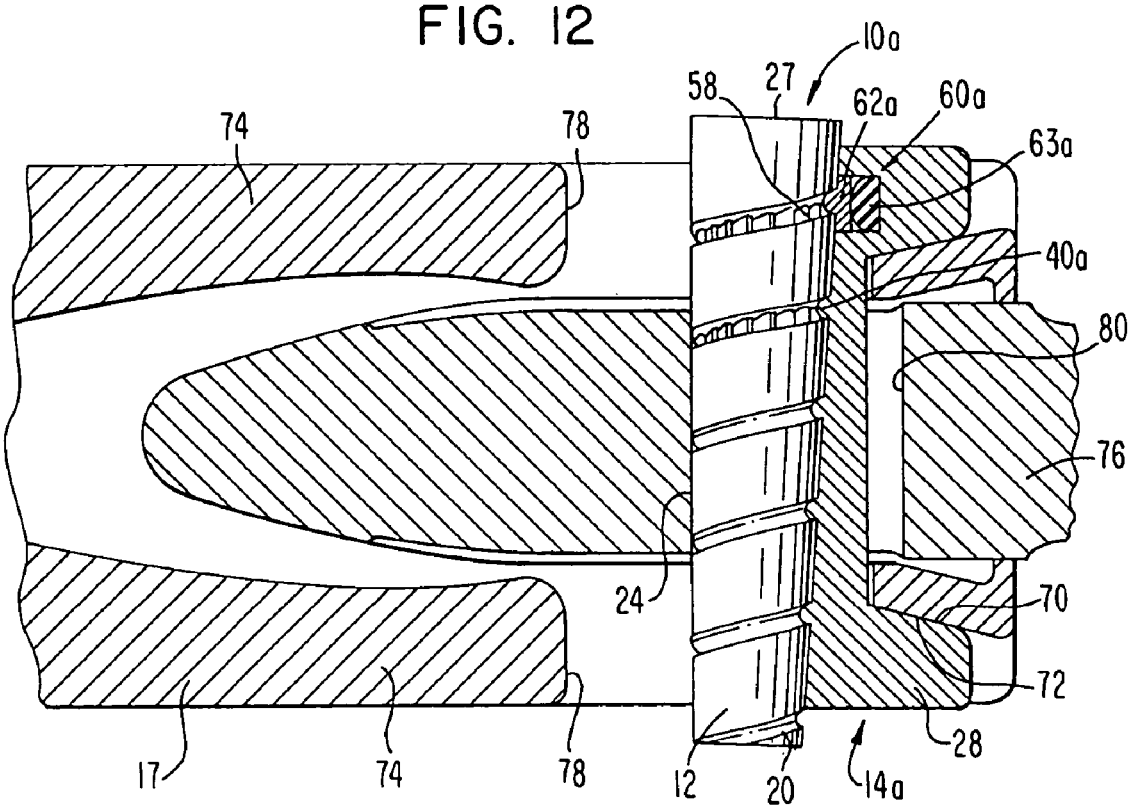
FIG. 12 is a cross-sectional view along a longitudinal axis of another wear assembly using the lock of FIG. 11.

Lock 10*a* is illustrated with a spool 14*a* that is adapted for use in a Whisler-style attachment (FIGS. 11 and 12). Nevertheless, a spool with a latch, like latch 60*a*, could be used to secure a point to an adapter, a shroud to a lip, or to secure other separable components together. In the illustrated embodiment, arms 28*a* of spool 14*a* are formed with inner surfaces 70 that diverge as they extend away from body 26*a* to mate with the inclined surfaces 72 conventionally formed on the rear end of a Whisler-style adapter 17. In use, the bifurcated legs 74 of the adapter 17 straddle the lip 76 of the excavating bucket. Each of the legs includes an elongated hole 78 that is aligned with hole 80 formed in lip 76. The aligned holes 78, 80 cooperatively define an opening 82 into which lock 10*a* is received. As with lock 10, lock 10*a* is preferably installed as separate components with the spool 14*a* being installed in opening 82 first, but may possibly be installed as a unit with the wedge 12 only partially placed into recess 36*a*. In either event, once the lock 10*a* is inserted into opening 82, the wedge is rotated in the tightening direction to drive the wedge into the opening 82 (FIG. 12). The driving is continued until the spool arms sufficiently grip the adapter against lip. With elongated holes 78 in legs 74, the latch needs to be mounted in spool 14 or lip 80. Nevertheless, when used with such elongated openings, the lock can be re-tightened as needed in this arrangement after wear begins to occur in order to maintain the assembly in a tightened state. The variety of lock embodiments discussed above for use with the tooth can also be used in a Whisler style connection.

Figure 13:
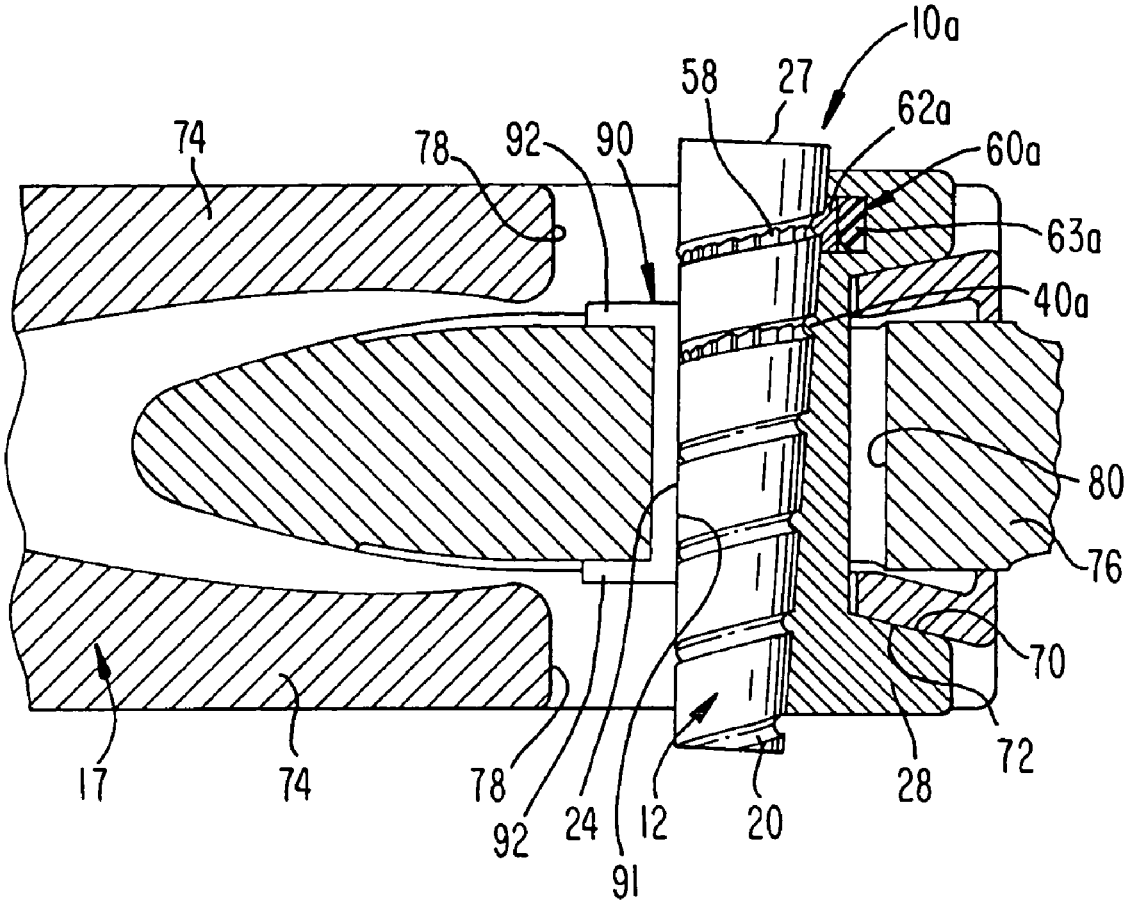
FIG. 13 is a cross-sectional view along the same line as FIG. 12 for an alternative embodiment including an insert between the wedge and support structure.
Figure 14:
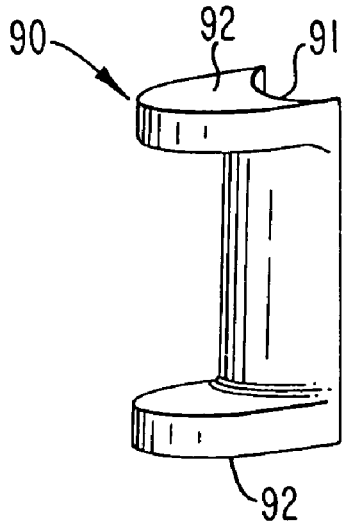
FIG. 14 is a perspective view of the insert used in the alternative embodiment of FIG. 13.

As noted above, an insert 90 can be provided as part of the lock between the front wall portion of the hole in the support structure and the wedge (FIGS. 13 and 14). In the illustrated embodiment, lock 10*b* is the same as lock 10*a* with the addition of insert 90; hence, common reference numbers have been used. The insert preferably includes a rear surface 91 provided a smooth recess to complement the shape of the wedge when the wedge is in the fully advanced position, although other shapes and/or the provision of ridges to be received in groove 20 (in addition to or in lieu of ridges 40) are possible. To prevent movement of the insert during turning of the wedge, the insert preferably includes lips 92 that are welded to lip 76. Nevertheless, a latch or other means could be used to secure the insert in place. The insert functions to protect the lip from wear and/or to fill an enlarged opening in the lip or other components.

A lock in accordance with the present invention could be used to secure other styles of adapters (or other wear members) to a bucket lip, such as disclosed in U.S. Pat. No. 6,986,216, which is hereby incorporated by reference in Its entirety, or as disclosed in co-pending patent application Ser. No. 10/425,605 filed Apr. 30, 2003, entitled Wear Assembly for Excavating Digging Edge, also herein incorporated in Its entirety by reference.

Other various alternatives can be used to provide additional support or to reduce the stress within the wedge during use and thereby increase the life of the components.

As one example, a wedge 12 and spool 114 (FIG. 17), having essentially the same construction as spool 14*a* (although other variations are possible), are shown holding an adapter 119 to a lip 176 of an excavating bucket. In this example, the ends of legs 174 of adapter 119 are adapted to fit against stop blocks 120 for additional support, although the stop blocks are not essential and could be omitted. In addition, insert 190, between wedge 12 and the front wall of the opening 180 in the lip, is provided with extended arms 192 to overlie the inner and outer surface of the lip. These extended arms provide additional support for the insert and increased surfaces by which the arms can be welded to the lip. As can be appreciated, a clearance 193 can be provided within the adapter to accommodate the increased arm length.

In a further example (FIGS. 18 and 19), a cradle 200 provided between the insert 190*a* and wedge 12. Cradle 200 preferably includes a trough shaped rear surface 202 (like surface 91 of insert 90 in FIG. 14) to bear against the wedge (although other surfaces are possible), and a curved, concave front face 204 (i.e., curved generally about a transverse axis). In this embodiment, the rear surface 191*a* of insert 190*a* complements cradle surface 204 so as to be curved generally about a transverse axis (instead of a vertical axis as shown, e.g., in FIG. 14 for insert 90). Nevertheless, front surface 204 of cradle 200 could also have a concave, curved form to define a generally vertical tough to receive insert 190 generally as spool 14*a* or insert 90 receive wedge 12. The rear wall 191*a* of the insert 190*a*, then, would have a complementary convex or crowned surface shape be received with in the formed trough. The trough and crowned surface could also be reversed with the trough on the insert and the crowned surface on the cradle. The front wall of opening 180 in lip 176 could be formed with the convex wall to directly abut the front face 204 of cradle 200, but an insert 190 is preferred to protect the lip and enable the fit with existing lip constructions.

When adapter 119 is used, the applied loads will tend to cause the adapter legs 174 to shift longitudinally, i.e., forward and rearward, along the inside and outside surfaces of the lip 176. Although the use of stop blocks 120 will limit the rearward motion, the legs will still tend to pull forward. In any event, this shifting of the legs can apply substantial compressive loading on the wedge and a build up of stress on the wedge, which leads to a reduced usable life. By using cradle 200, the wedge 12 and cradle 200 can swing about insert 190*a* (i.e., about the generally transverse axis) to accommodate the alternative shifting of the legs and thereby reduce the stress in the wedge, thus, increasing the usable life of the wedge.

Figure 18A:
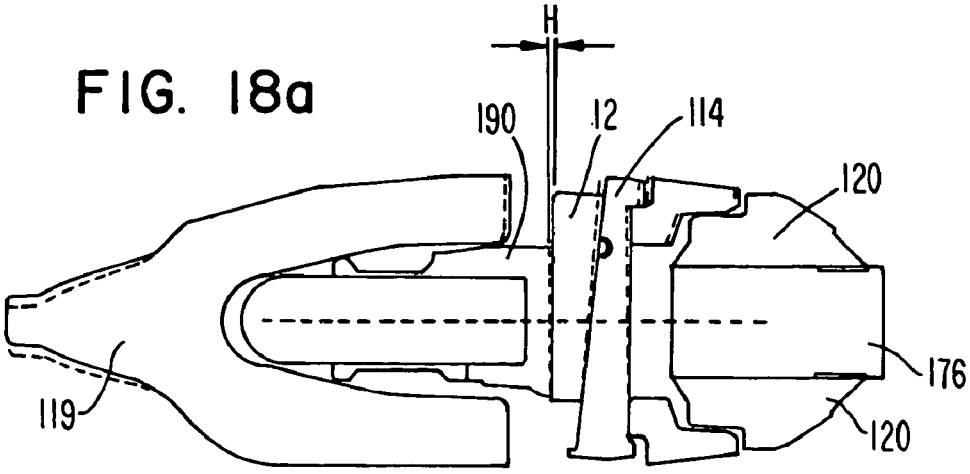
FIG. 18*a* is a cross-sectional view illustrating shifting of the wear member on a lock without a cradle.
Figure 18B:
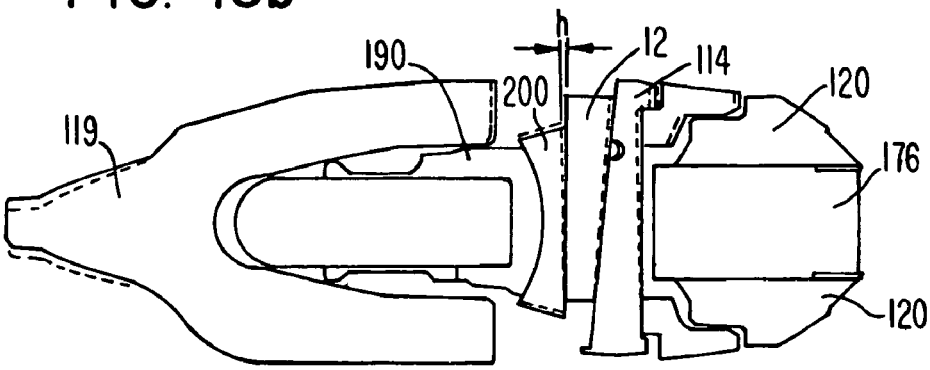
FIG. 18*b* is a cross-sectional view illustrating shifting of the wear member on a lock with cradle.
Figure 19:
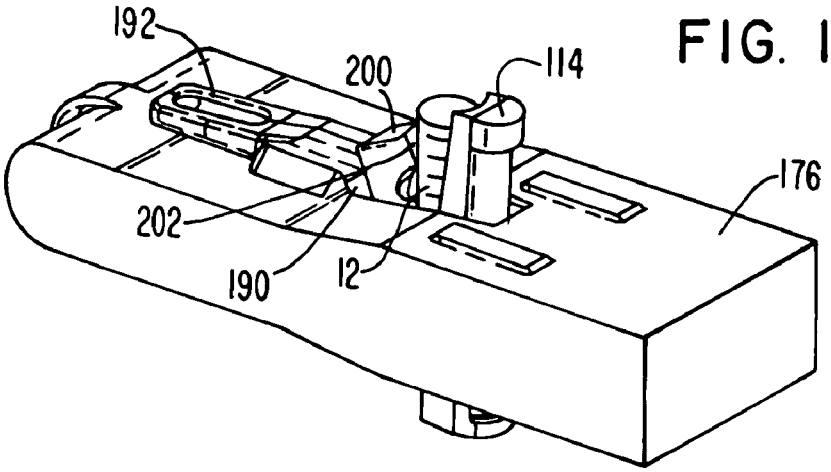
FIG. 19 is a perspective view of a cradle used in the alternative embodiment shown in FIG. 18 with the wear member omitted.

For example, as shown in FIGS. 18*a* and 18*b*, the application of a downward load on the front of the adapter will tend to cause the upper leg of adapter 119 to shift forward along the inside surface of the lip 176. When used without stop blocks 120, there will also be a concomitant rearward shifting of the lower leg. In regard to the present example, this forward shifting of the upper leg can cause a high compressive force to be applied to the wedge and create an interference fit H of certain magnitude that is usually accommodated by compression of the wedge. With the use of a cradle, as illustrated in FIG. 18*b*, the forward shifting of the upper leg is at least partially accommodated by shifting of the cradle so that the interference fit h is smaller in magnitude than interference H for the same amount of forward shifting of the adapter leg. The shifting of the wedge enables the lock to automatically adjust so as to increase the contact surface area resisting the loads and thereby reduce the likelihood of localized peening or other damage to the lock components—particularly the wedge.

Figure 20:
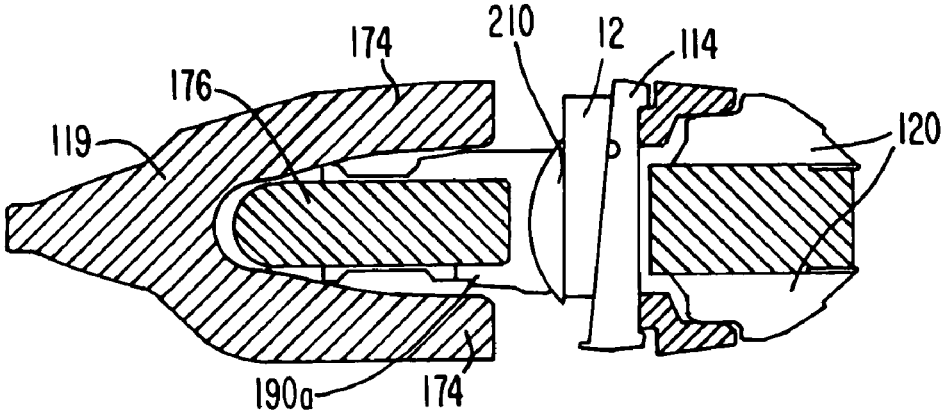
FIG. 20 is a cross-sectional view along the same line as FIG. 12 for another alternative embodiment.

In an alternative embodiment (FIG. 20), cradle 210 includes a curved convex front surface 212 (i.e., curved about a generally transverse axis) to be received against a concave rear surface of insert 190*b*. In this embodiment, the cradle and wedge are adapted to shift to accommodate the shifting of the legs of the adapter 119 under load as discussed above for cradle 200.

Figure 21:
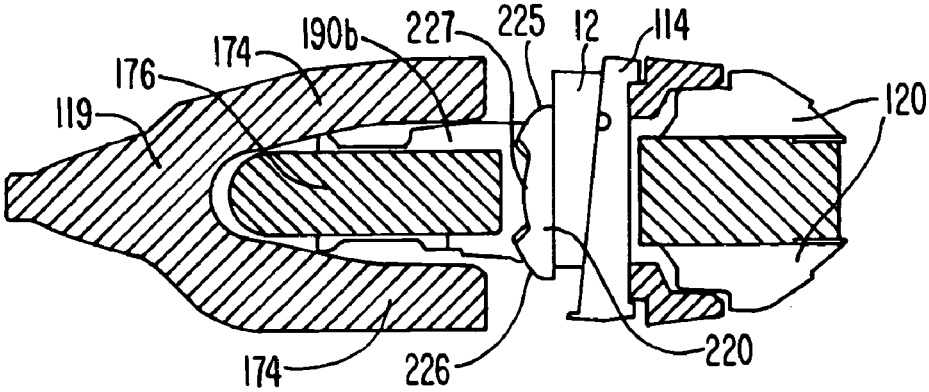
FIG. 21 is a cross-sectional view along the same line as FIG. 12 for another alternative embodiment.
Figure 22:
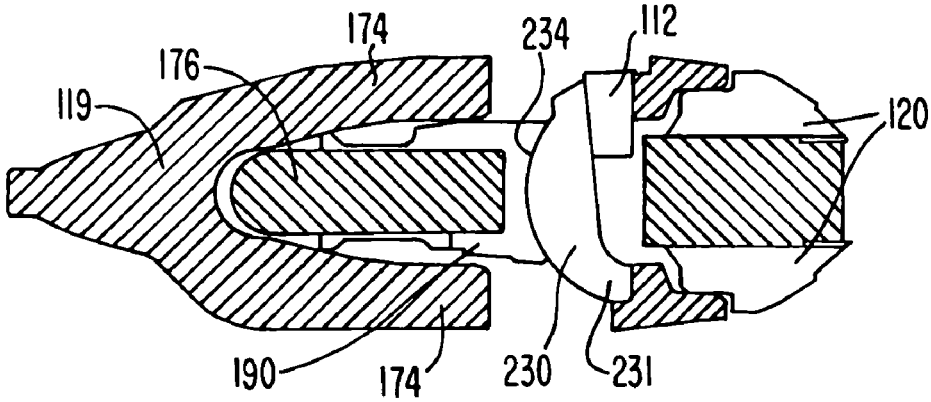
FIG. 22 is a cross-sectional view along the same line as FIG. 12 for another alternative embodiment.

As another alternative construction (FIG. 21), cradle 220 is formed with a front face 224 having an offset formation. More specifically, front face 224 includes an upper portion 225 and a lower portion 226, each having a convex curvature such as used in cradle 210. The central portion 227 of front face 224 has recessed convex curved surface preferably about the same radius of curvature origination point as upper and lower portions 225, 226. Insert 190*b* has a complementary rear surface. Cradle 220, thus, operates in essentially the same way as cradle 210, but is thinner for use in smaller openings in lip 176 and adapter 119.

As another alternative, cradle 230 can be used with a shortened wedge 112 to accommodate the shifting of the adapter legs 174. In this embodiment, the spool is also eliminated. More specifically, cradle 230 includes a convex front face 234, in generally the same way as cradle 210. However, cradle 230 also includes an extended arm 231 which abuts against the lower leg 174 in place of spool 14.

Further, cradles can be used in the same way with conventional wedge and spool arrangements (i.e., non-rotating wedges) to provide the same shifting of the lock to better accommodate shifting of the legs.

Figure 23:
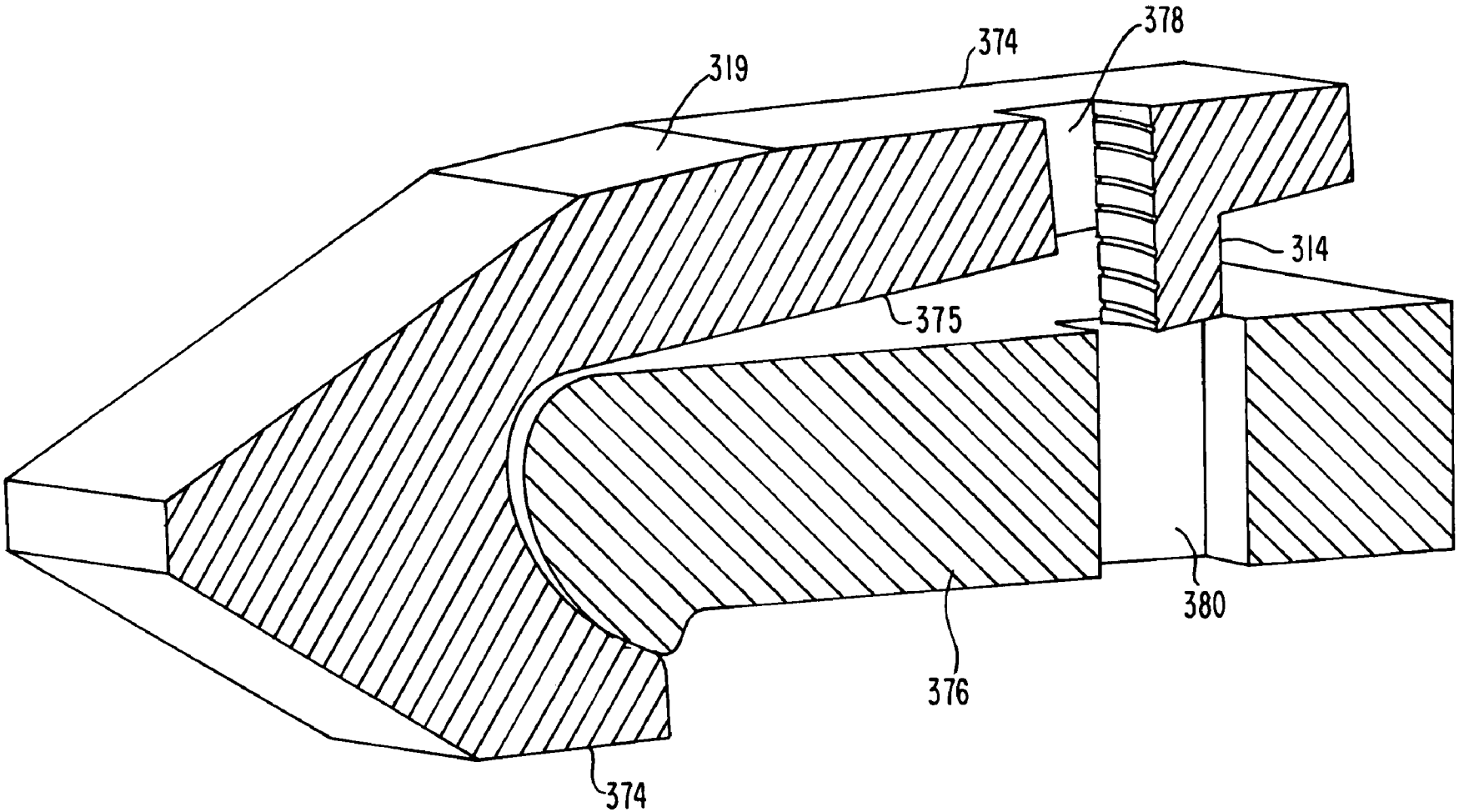
FIG. 23 is an perspective view of another alternative embodiment wherein the wear member is partially fit onto a lip.
Figure 24:
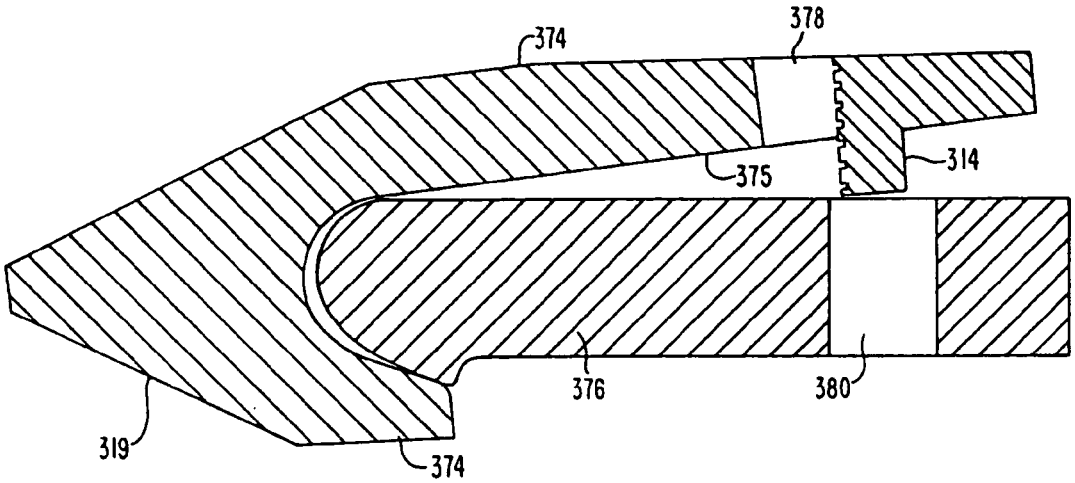
FIG. 24 is a side view of the embodiment of FIG. 23 in the same orientation.
Figure 25:
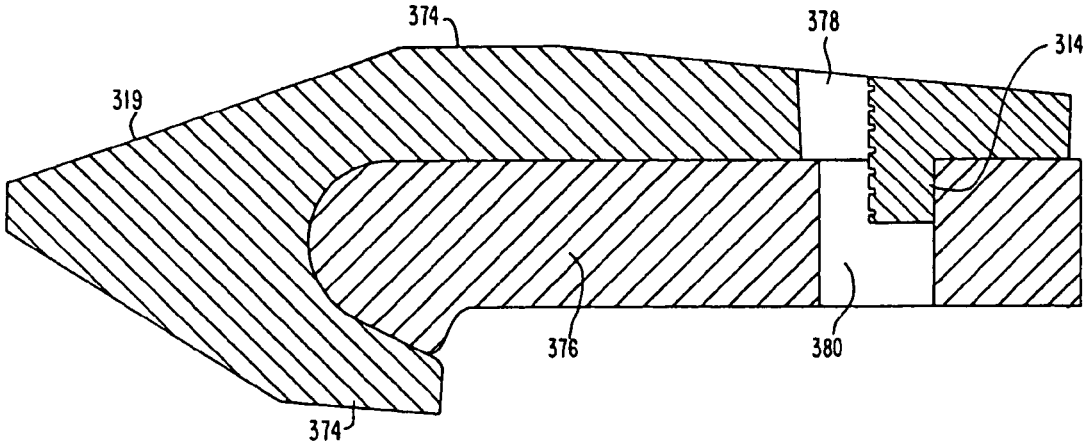
FIG. 25 is a partial cross-sectional view of the fit of the wear member in FIG. 23 with the hole in the lip when fully fit on the lip.

In another alternative embodiment (FIGS. 23–25), the spool 314 is formed integrally with the wear member 319. In this construction, a shroud 319 or other wear member includes a pair of legs 374 to straddle the lip 376. One leg 374*a* (in this example, the inner leg) is formed with an opening 378 for receiving a wedge 12. A spool 314 is cast (or otherwise formed) as an integral portion of leg 374 to form the rear wall of opening 378. Spool 314 is provided with the same front construction as disclosed above for spool 14*a* (or spool 14). Spool 314 further projects from an inner side 375 of leg 374 to fit within hole 380 in lip 376 against rear wall 381. Leg 374*b* is shorter than leg 374*a* to enable the wear member 319 to swing onto lip 376 and place shroud 314 into opening 380. In FIGS. 23 and 24, wear member 319 is shown partially swung about lip 376 with shroud 314 about to be placed within hole 380 in lip 376. Once wear member 319 is fully fit on lip 376, wedge 12 is inserted and tightened as disclosed above.

The lock of the present invention can also be used in a variety of different assemblies to hold separable parts together. While the invention is particularly suited for use in securing a point to an adapter, and an adapter or shroud to a lip, the invention can be used to secure other wear members in excavating operations, or simply other separable components that may or may not be used in excavating operations. Further, the above-discussion concerns the preferred embodiments of the present invention. Various other embodiments as well as many changes and alterations may be made without departing from the spirit and broader aspects of the invention as defined in the claims.

The invention claimed is:

1. A wear assembly for excavating equipment comprising a support structure, a wear member mounted on the support structure and a lock releasably securing the wear member on the support structure, the support structure and the wear member cooperatively defining an opening for receiving the lock, the lock comprising a wedge having a leading end, a trailing end, a length extending between the leading and trailing ends, and a rounded cross section, the wedge tapering toward the lead end along substantially the entire length, and being formed with a helical thread that extends axially along an exterior surface of the wedge, the helical thread being threadedly coupled to a thread formation in the opening such that rotation of the wedge moves the wedge into the opening to tighten the lock in the opening.

2. A wear assembly in accordance with claim 1 wherein the helical thread on the wedge is defined by a helical groove.

3. A wear assembly in accordance with claim 2 wherein the groove has a large pitch so that a substantial portion of the exterior surface of the wedge exists between each pair of turns of the groove to provide a bearing surface for the lock.

4. A wear assembly in accordance with claim 1 further comprising a spool fit between the wedge and a wait of the opening the wedge being movable along the spool as the wedge is tightened in the opening.

5. A wear assembly in accordance with claim 4 wherein the helical thread on the wedge is defined by a helical groove.

6. A wear assembly in accordance with claim 5 wherein the thread formation in the opening is formed on the spool as at least one projection to engage the groove.

7. A wear assembly in accordance with claim 6 further including a retainer to resist loosening of the wedge.

8. A wear assembly in accordance with claim 7 wherein the wedge includes a series of teeth and the retainer includes a resiliently biased detent to engage the teeth.

9. A wear assembly in accordance with claim 8 wherein the teeth are formed in the groove.

10. A wear assembly in accordance with claim 9 wherein the engagement of the detent with the teeth permits rotation of the wedge in only one direction.

11. A wear assembly in accordance with claim 7 wherein the retainer is mounted on the wear member.

12. A wear assembly in accordance with claim 7 wherein the retainer is mounted on the spool.

13. A wear assembly in accordance with claim 4 wherein the spool engages the wear member and the wedge engages the support structure.

14. A wear assembly in accordance with claim 4 wherein the spool has a generally C-shaped configuration that includes a body and a pair of arms.

15. A wear assembly in accordance with claim 4 further including an insert that engages the wedge opposite the spool.

16. A wear assembly in accordance with claim 4 wherein the helical thread on the wedge is a helical ridge and the thread formation in the opening is a groove structure.

17. A wear assembly in accordance with claim 16 further including an insert that engages the wedge opposite the spool.

18. A wear assembly in accordance with claim 17 wherein the insert includes a groove structure to receive the helical ridge.

19. A wear assembly in accordance with claim 4 wherein the spool is integrally formed with the wear member.

20. A wear assembly in accordance with claim 19 wherein the spool and the wear member are cast as a one-piece member.

21. A wear assembly in accordance with claim 4 further including a cradle to contact the wedge along a side opposite the spool, the cradle having a front surface that is curved generally about a transverse axis to better accommodate shifting of the vertical orientation of the lock during use.

22. A wear assembly in accordance with claim 21 further comprising an insert between the front of the opening and the cradle, the insert having a rear surface that complements the front surface of the cradle.

23. A wear assembly in accordance with claim 21 wherein the front face of the cradle includes a curved concave surreys generally about the transverse axis.

24. A wear assembly in accordance with claim 1 wherein the wear member is a point and the support structure is an adapter that attach together to form an excavating tooth.

25. A wear assembly in accordance with claim 1 wherein the wear member is an adapter and the support structure is a lip of an excavating bucket.

26. A wear assembly in accordance with claim 1 further including a retainer to resist loosening of the wedge.

27. A wear assembly in accordance with claim 1 wherein the first heroical thread on the wedge in a tapping thread.

28. A wear assembly in accordance with claim 1 further comprising means of effecting shifting of the vertical orientation of the wedge as the wear member shifts on the support structure.

29. A wear assembly in accordance with claim 1 further including a cradle to contact the wedge along a front side thereof, the cradle having a front surface that is curved generally about a transverse axis to better accommodate shifting of the vertical orientation of the lock during use.

30. A wear assembly in accordance with claim 29 further comprising an insert between the front of opening and the cradle, the insert having a rear surface that complements the front surface of the cradle.

31. A wear assembly in accordance with claim 29 wherein the front face of the cradle includes a curved concave surface generally about the transverse axis.

32. A wear assembly in accordance with claim 4 wherein the spool includes a retainer for resisting loosening of the wedge in the opening.

33. A wear assembly in accordance with claim 32 wherein the spool has a generally C-shaped configuration that includes a body and a pair of arms.

34. A wear assembly in accordance with claim 33 wherein the arms each include an inner edge that faces toward the other arm, and wherein the inner edges diverge from each other as they extend away from the body.

35. A wear assembly for excavating equipment comprising a support structure, a wear member having a front working portion and a rear portion configured to mount on the support structure, and a took releasably securing the wear member on the support structure, the support structure and the wear member cooperatively defining an opening for receiving the lock, the lock comprising a wedge that tapers toward one end and is movable into the opening to tighten the lock in the opening, and a cradle fit between the wedge and the front of the opening, the cradle having a curved front surface generally about a transverse axis to fit against a complementary surface in the opening to effect shifting of the vertical orientation of the wedge as the wear member shifts longitudinally on the support structure during use.

36. A wear assembly in accordance with claim 35 further comprising an insert between the front of the opening and the cradle, the insert having a rear surface that complements the front surface of the cradle.

37. A wear assembly in accordance with claim 35 wherein the front face of the cradle includes a curved concave surface generally about the transverse axis.

38. A wear assembly in accordance with claim 35 wherein the wear member is an adapter and the support structure is a lip of an excavating bucket.

39. A method of attaching a wear member to a support structure for use with excavating equipment comprising placing the wear member on the support structure such that formations in the wear member and the support structure cooperatively define an opening.

inserting a wedge into the opening having a leading end, a trailing end, a length extending between the leading and trailing ends, and a rounded cross section, the wedge tapering toward the leading end along substantially the entire length, and being formed with a helical thread that extends axially along an exterior surface of the wedge, threadedly coupling the helical thread to a thread formation in the opening, and rotating the wedge when in the opening to drive the wedge further into the opening to tightly retain the wear member on the support structure.

40. A method in accordance with claim 39 further comprising inserting a spool into the opening, the spool having the thread formation in the opening to threadedly engage the wedge.

41. A method in accordance with claim 40 further including a retainer to resist loosening of the wedge.

42. A method in accordance with claim 39 further including a retainer to resist loosening of the wedge.

43. A method in accordance with claim 39 wherein the wear member is a point and the support structure is an adapter that attach together to form an excavating tooth.

44. A method in accordance with claim 39 wherein the wear member is an adapter and the support structure is a lip of an excavating bucket.

* * * * *

UNITED STATES PATENT AND TRADEMARK OFFICE

CERTIFICATE OF CORRECTION

PATENT NO. : 7,174,661 C1
APPLICATION NO. : 95/000437
DATED : December 14, 2010
INVENTOR(S) : Terry L. Briscoe It is certified that error appears in the above-identified patent and that said Letters Patent is hereby corrected as shown below:

In the Specification

In Column 6, Line 5, "formation" should be changed to --formations--.

Signed and Sealed this
Sixth Day of May, 2014

Michelle K. Lee

Michelle K. Lee
*Deputy Director of the United States Patent and Trademark Office*

US007174661C1

(12) INTER PARTES REEXAMINATION CERTIFICATE (0218th)

United States Patent

Briscoe

(10) Number: US 7,174,661 C1

(45) **Certificate Issued: *Dec. 14, 2010**

(54) RELEASABLE COUPLING ASSEMBLY

(75) Inventor: Terry L. Briscoe, Portland, OR (US)

(73) Assignee: ESCO Corporation, Portland, OR (US)

Reexamination Request:
No. 95/000,437, Feb. 3, 2009

Reexamination Certificate for:

| | |
|---|---|
| Patent No.: | **7,174,661** |
| Issued: | **Feb. 13, 2007** |
| Appl. No.: | **10/824,490** |
| Filed: | **Apr. 15, 2004** |

( * ) Notice: This patent is subject to a terminal disclaimer.

Related U.S. Application Data

(63) Continuation-in-part of application No. 10/425,934, filed on Apr. 30, 2003, now Pat. No. 7,171,771.

(51) Int. Cl.
*E02F 9/28* (2006.01)

(52) U.S. Cl. ..... 37/455; 37/456; 37/457; 403/370; 403/374.4

(58) Field of Classification Search ..... 37/455–457; 403/370, 374.4
See application file for complete search history.

(56) References Cited

U.S. PATENT DOCUMENTS

| | | | | |
|---|---|---|---|---|
| 3,121,289 A | * | 2/1964 | Eyolfson | 37/456 |
| 4,357,765 A | | 11/1982 | Seykora | |
| 4,360,981 A | | 11/1982 | Bierwith et al. | |
| 4,372,703 A | | 2/1983 | Szostak | |
| 4,380,102 A | * | 4/1983 | Hansson | 24/459 |
| 4,413,432 A | | 11/1983 | Bierwith | |
| 4,433,496 A | | 2/1984 | Jones et al. | |
| 4,570,365 A | | 2/1986 | Bierwith | |
| 5,016,365 A | | 5/1991 | Robinson | |
| 5,068,986 A | | 12/1991 | Jones | |
| 5,134,793 A | | 8/1992 | Bierwith | |
| 5,169,033 A | | 12/1992 | Shay | |

(Continued)

FOREIGN PATENT DOCUMENTS

| | | |
|---|---|---|
| EP | 0 847 480 B1 | 10/1999 |
| ES | 2140121 T3 | 2/2000 |
| GB | 2 125 137 A | 2/1984 |
| WO | WO00/020696 | 4/2000 |

OTHER PUBLICATIONS

Request for Inter Partes Reexamination Under 37 CFR 1.913ff, Dated May 6, 2009, In re application of: Terry L. Briscoe, Pat. No. 7171771, Issued Feb. 6, 2007, For "Releasable Coupling Assembly," 105 pgs.

U.S. Appl. No. 11/705,637, Non–Final Office Action mailed Aug. 20, 2009, Author: Thomas A. Beach, 5 pgs.

U.S. Appl. No. 11/705,637, Search Notes, Date: Aug. 14, 2009, Author: Thomas A. Beach, 1 pg.

U.S. Appl. No. 11/705,637, East Search History, Date: Aug. 17, 2009, Author: Thomas A. Beach. 8 pgs.

U.S. Appl. No. 11/705,637, Applicant's Arguments/Remarks Made in an Amendment, Date: Sep. 4, 2009, Author: Steven P. Schad, 10 pgs.

*Primary Examiner*—Jimmy G Foster

(57) ABSTRACT

A lock that includes a wedge that is used to releasably secure separable components of an asembly together. The wedge can be used with a spool. The wedge and spool are threadedly coupled together to drive the wedge into and out of an opening in the assembly without hammering or prying. The direct coupling of the wedge and spool eliminates the need for bolts, washers, nuts and other hardware so as to minimize the number of parts. As a result, the lock is inexpensive to make, easy to use, and unlikely to become inoperative because of lost or broken parts or due to fines or other difficulties encountered in harsh digging environments. Further, the wedge can be driven into the assembly to provide the degree of tightness necessary for the intended operation and/or to re-tighten the assembly after incurring wear during use. A latch assembly is preferably provided to securely hold the wedge in place and avoid an undesired loss of parts during use.

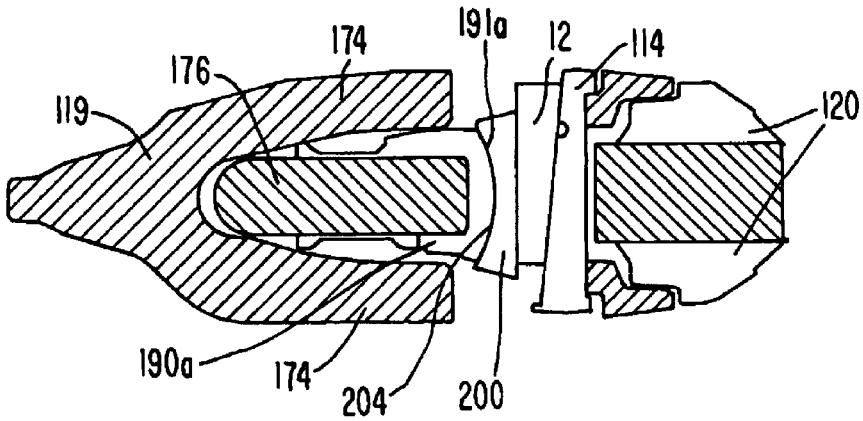

U.S. PATENT DOCUMENTS 5,331,754 A 7/1994 Ruvang
5,410,826 A 5/1995 Immel et al.
5,465,512 A * 11/1995 Livesay et al. ..... 37/457
5,469,648 A 11/1995 Jones et al.
5,487,230 A 1/1996 Weyer
5,653,048 A 8/1997 Jones et al.
5,666,748 A 9/1997 Emrich et al.
5,709,043 A 1/1998 Jones et al.
5,713,145 A 2/1998 Ruvang
5,718,070 A 2/1998 Ruvang
5,784,813 A 7/1998 Balassa et al.
5,868,518 A 2/1999 Chesterfield et al.
5,913,605 A 6/1999 Jusselin et al.
5,937,549 A 8/1999 Bender et al.
5,937,550 A 8/1999 Emrich
5,964,547 A 10/1999 Brinkley
5,983,534 A 11/1999 Robinson et al.
6,009,644 A 1/2000 Hedley
6,144,762 A 11/2000 Brooks
6,209,238 B1 4/2001 Ruvang
6,282,991 B1 9/2001 Hu
6,301,810 B1 10/2001 Fidler
6,321,471 B2 11/2001 Fernandez Munoz et al.
6,729,052 B2 5/2004 Ollinger, IV et al.
6,735,890 B2 5/2004 Carpenter et al.
6,735,891 B2 5/2004 Pallas Moreno et al.
6,745,503 B1 6/2004 Pallas Moreno et al.
6,959,506 B2 11/2005 Adamic et al.
6,986,216 B2 1/2006 Emrich et al.
6,993,861 B2 2/2006 Carpenter et al.
7,090,006 B2 8/2006 Salama

* cited by examiner

INTER PARTES REEXAMINATION CERTIFICATE ISSUED UNDER 35 U.S.C. 316

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

New claims 45-70 are added and determined to be patentable.

Claims 1-44 were not reexamined.

*45. A wear assembly for excavating equipment including an excavating bucket, the wear assembly comprising:*

*a support structure in a fixed relation to the excavating bucket,*

*a wear member mounted on the support structure, the wear member being positioned to contact the ground in a digging operation, and*

*a lock releasably securing the wear member on the support structure,*

*the support structure and the wear member cooperatively defining an opening for receiving the lock,*

*the lock comprising a wedge having a leading end, a trailing end, a length extending between the leading and trailing ends, and a rounded cross section, the wedge tapering toward the leading end along substantially the entire length, and being formed with a helical thread that extends axially along an exterior surface of the wedge, and*

*the helical thread being threadedly coupled to a thread formation in the opening such that rotation of the wedge moves the wedge into the opening to tighten the lock in the opening and securely hold the wear member to the excavating bucket,*

*further including a spool positioned in the opening, the spool defining the thread formation in the opening,*

*wherein the spool includes a generally trough shaped recess into which the wedge is received, and the thread formation is defined in the recess.*

*46. A wear assembly in accordance with claim 45 wherein the wedge contacts and presses against the spool in the recess over a plurality of turns of the helical thread.*

*47. A wear assembly in accordance with claim 46 wherein the wedge contacts and presses against the support structure in the opening over a plurality of turns of the helical thread.*

*48. A wear assembly in accordance with claim 46 wherein the spool includes a body and a pair of rearwardly extending arms that straddle the wear member.*

*49. A wear assembly in accordance with claim 48 wherein the opening has an inlet end through which the spool and the wedge are inserted into the opening, and the body of the spool widens in a direction front to rear as the body extends away from the inlet end of the opening.*

*50. A wear assembly in accordance with claim 46 wherein the recess of the spool receiving the wedge is tapered such that forward portions of the wedge are in a vertical orientation.*

*51. A wear assembly in accordance with claim 46 further including an insert to engage the support structure and the wedge opposite the spool.*

*52. A wear assembly in accordance with claim 46 wherein the opening has an inlet end through which the spool and the wedge are inserted into the opening, and the body of the spool widens in a direction front to rear as the body extends away from the inlet end of the opening.*

*53. A wear assembly in accordance with claim 45 further including an insert to engage the support structure and the wedge opposite the spool.*

*54. A wear assembly in accordance with claim 53 wherein the insert includes a generally trough shaped recess to receive the wedge.*

*55. A wear assembly for excavating equipment including an excavating bucket, the wear assembly comprising:*

*a support structure in a fixed relation to the excavating bucket,*

*a wear member mounted on the support structure, the wear member being positioned to contact the ground in a digging operation, and*

*a lock releasably securing the wear member on the support structure,*

*the support structure and the wear member cooperatively defining an opening for receiving the lock,*

*the lock comprising a wedge having a leading end, a trailing end, a length extending between the leading and trailing ends, and a rounded cross section, the wedge tapering toward the leading end along substantially the entire length, and being formed with a helical thread that extends axially along an exterior surface of the wedge, and*

*the helical thread being threadedly coupled to a thread formation in the opening such that rotation of the wedge moves the wedge into the opening to tighten the lock in the opening and securely hold the wear member to the excavating bucket,*

*wherein the helical thread on the wedge includes a helical groove, and the thread formation in the opening is defined by a plurality of spaced ridge segments that are received into and engage a plurality of turns of the helical groove,*

*wherein each said ridge segment is shaped as a helical segment for receipt in the helical groove.*

*56. A wear assembly for excavating equipment including an excavating bucket, the wear assembly comprising*

*a suppport structure in a fixed relation to the excavating bucket,*

*a wear member mounted on the support structure, the wear member being positioned to contact and penetrate the ground in a digging operation, and*

*a lock releasably securing the wear member on the support structure,*

*the support structure and the wear member cooperatively defining an opening for receiving the lock, the opening having an inlet end through which the wedge is inserted into the opening,*

*the lock comprising a wedge having a leading end, a trailing end, a length extending between the leading and trailing ends, and a rounded cross section, the wedge tapering toward the leading end along substantially the entire length, and being formed with a helical thread that extends axially along an exterior surface of the wedge, the helical thread on the wedge including a helical groove,*

*the helical thread being threadedly coupled to a thread formation in the opening such that rotation of the wedge moves the wedge into the opening to tighten the lock in the opening and securely hold the wear member to the excavating bucket, and*

*the thread formation in the opening being defined by a plurality of spaced ridge segments that are received into and engage a plurality of turns of the helical groove, each said ridge segment is shaped as a helical segment for receipt in the helical groove.*

*57. A wear assembly in accordance with claim 56 further including a spool positioned in the opening, wherein the spool includes a generally trough shaped recess for receiving the wedge, and the recess includes the ridge segments.*

*58. A wear assembly in accordance with claim 57 wherein the wedge contacts and presses against each of the support structure and the spool over a plurality of turns of the helical groove.*

*59. A wear assembly in accordance with claim 57 wherein the opening has an inlet end through which the spool and the wedge are inserted into the opening, and the body of the spool widens in a direction front to rear as the body extends away from the inlet end of the opening.*

*60. A wear assembly in accordance with claim 59 wherein the recess of the spool receiving the wedge is tapered such that forward portions of the wedge are in a vertical orientation.*

*61. A wear assembly in accordance with claim 60 wherein the spool includes a pair of rearwardly extending arms that straddle the wear member.*

*62. A wear assembly in accordance with claim 57 further including an insert to engage the support structure and the wedge opposite the spool.*

*63. A wear assembly in accordance with claim 62 wherein the insert includes a generally trough shaped recess for receiving the wedge.*

*64. A wear assembly for excavating equipment including an excavating bucket, the wear assembly comprising:*

*a support structure, the support structure being a lip of the excavating bucket, the lip including a through-hole,*

*a wear member mounted on the support structure, the wear member being an adapter having a forwardly projecting nose to support a point in the formation of an excavating tooth that contacts and penetrates the ground during a digging operation, and a pair of rearwardly extending legs that straddle the lip, each said leg including a hole, and each said hole being generally aligned with the through-hole in the lip when the legs straddle the lip, and*

*a lock releasably securing the wear member on the support structure,*

*the support structure and the wear member cooperatively defining an opening for receiving the lock by the holes in the legs being generally aligned with the through-hole in the lip,*

*the lock comprising a wedge and a spool,*

*the wedge having a leading end, a trailing end, a length extending between the leading and trailing ends, and a rounded cross section, the wedge tapering toward the leading end along substantially the entire length, and being formed with a helical thread that extends axially along an exterior surface of the wedge, the helical thread including a helical groove,*

*the spool including a body and a pair of rearwardly extending arms that straddle the legs of the adapter rearward of the holes in the legs, the body having a generally trough shaped recess to receive the wedge,*

*the spool contacting the wedge along a plurality of turns of the helical groove on the wedge, and*

*the helical thread being threadedly coupled to a thread formation in the opening such that rotation of the wedge moves the wedge into the opening to tighten the lock in the opening and securely hold the wear member to the excavating bucket, the thread formation in the opening being defined by spaced thread segments on the spool that are received into and engage the helical groove along a plurality of turns of the helical groove,*

*wherein the lock further includes an insert to engage the support structure and the wedge opposite the spool, and*

*wherein the insert includes a generally trough shaped recess to receive the wedge, and wherein the insert contacts the wedge along a plurality of turns of the helical groove on the wedge.*

*65. A wear assembly in accordance with claim 64 wherein the insert includes a pair of forwardly extending arms to straddle the lip forward of the through-hole.*

*66. A wear assembly for excavating equipment including an excavating bucket, the wear assembly comprising:*

*a support structure, the support structure being an adapter that is secured to a lip of the excavating bucket, the adapter having a nose that projects forward of the lip,*

*a wear member mounted on the support structure, the wear member being a point with a rearwardly-opening socket to receive the nose of the adapter, and a front digging edge that contacts and penetrates the ground during a digging operation, and*

*a lock releasably securing the wear member on the support structure,*

*the support structure and the wear member cooperatively defining an opening for receiving the lock,*

*the lock comprising a wedge having a leading end, a trailing end, a length extending between the leading and trailing ends, and a rounded cross section, the wedge tapering toward the leading end along substantially the entire length, and being formed with a helical thread that extends axially along an exterior surface of the wedge, the helical thread including a helical groove,*

*the helical thread being threadedly coupled to a thread formation in the opening such that rotation of the wedge moves the wedge into the opening to tighten the lock in the opening and securely hold the wear member to the excavating bucket, the thread formation including spaced ridge segments that are received into and engage the helical groove over a plurality of turns of the helical groove,*

*wherein the spaced ridge segments are formed on the wear member.*

*67. A wear assembly for excavating equipment including an excavating bucket, the wear assembly comprising:*

*a support structure, the support structure being an adapter that is secured to a lip of the excavating bucket, the adapter having a nose that projects forward of the lip,*

*a wear member mounted on the support structure, the wear member being a point with a rearwardly-opening socket to receive the nose of the adapter, and a front digging edge that contacts and penetrates the ground during a digging operation, and*

*a lock releasably securing the wear member on the support structure,*

*the support structure and the wear member cooperatively defining an opening for receiving the lock,*

*the lock comprising a wedge having a leading end, a trailing end, a length extending between the leading and trailing ends, and a rounded cross section, the wedge tapering toward the leading end along substantially the entire length, and being formed with a helical thread that extends axially along an exterior surface of the wedge, the helical thread including a helical groove,*

*the helical thread being threadedly coupled to a thread formation in the opening such that rotation of the wedge moves the wedge into the opening to tighten the lock in the opening and securely hold the wear member to the excavating bucket, the thread formation including spaced ridge segments that are received into and engage the helical groove over a plurality of turns of the helical groove,*

*further including a spool positioned in the opening, wherein the spool includes a generally trough shaped recess for receiving the wedge, and the recess includes the ridge segments.*

*68. A method of attaching a wear member in the form of an excavating tooth adapter to a support structure in the form of a lip of a bucket for use with excavating equipment, the method comprising:*

*placing the wear member on the support structure with legs of the adapter straddling the lip such that hole formations in the legs of the wear member and in the support structure are generally aligned to cooperatively define an opening,*

*inserting a spool into the opening such that arms of the spool straddle the legs of the adapter rearward of the opening,*

*inserting a wedge into the opening between the support structure and the spool, the wedge having a leading end, a trailing end, a length extending between the leading and trailing ends, and a rounded cross section, the wedge tapering toward the leading end along substantially the entire length, and being formed with a helical thread that extends axially along an exterior surface of the wedge, the helical thread including a helical groove,*

*threadedly coupling the helical thread to a thread formation formed on the spool in the opening, and*

*rotating the wedge when in the opening to receive spaced segments of the thread formation into the helical groove and to drive the wedge further into the opening to tightly retain the wear member on the support structure,*

*wherein inserting the wedge into the opening includes placing the wedge into a generally trough shaped recess on the spool, and*

*wherein the thread formation is in the recess of the spool so that the threaded coupling of the helical thread to the thread formation is in the recess of the spool.*

*69. A method of attaching a wear member in the form of an excavating tooth point to a support structure in the form of an excavating tooth adapter secured to a lip of a bucket for use with excavating equipment, the method comprising:*

*placing the wear member on the support structure such that a socket in the point is received over a nose of the adapter and formation in the wear member and the support structure cooperatively define an opening,*

*inserting a wedge into the opening having a leading end, a trailing end, a length extending between the leading and trailing ends, and a rounded cross section, the wedge tapering toward the leading end along substantially the entire length, and being formed with a helical thread that extends axially along an exterior surface of the wedge, the helical thread including a helical groove,*

*threadedly coupling the helical thread to a thread formation in the opening, and*

*rotating the wedge when in the opening to receive spaced segments of the thread formation into the helical groove and to drive the wedge further into the opening to tightly retain the wear member on the support structure,*

*wherein the helical thread of the wedge is threadedly coupled to the thread formation which is defined on the wear member.*

*70. A method of attaching a wear member in the form of an excavating tooth point to a support structure in the form of an excavating tooth adapter secured to a lip of a bucket for use with excavating equipment, the method comprising:*

*placing the wear member on the support structure such that a socket in the point is received over a nose of the adapter and formations in the wear member and the support structure cooperatively define an opening,*

*inserting a wedge into the opening having a leading end, a trailing end, a length extending between the leading and trailing ends, and a rounded cross section, the wedge tapering toward the leading end along substantially the entire length, and being formed with a helical thread that extends axially along an exterior surface of the wedge, the helical thread including a helical groove,*

*threadedly coupling the helical thread to a thread formation in the opening, and*

*rotating the wedge when in the opening to receive spaced segments of the thread formation into the helical groove and to drive the wedge further into the opening to tightly retain the wear member on the support structure,*

*further including inserting a spool into the opening before inserting the wedge, and receiving the wedge into a generally trough shaped recess in the spool,*

*wherein the thread formation is in the recess of the spool so that the threaded coupling of the helical thread to the thread formation is in the recess of the spool.*

* * * * *